US006047808A

United States Patent [19]

Neubarth et al.

[11] Patent Number: 6,047,808

[45] Date of Patent: Apr. 11, 2000

[54] COIN SENSING APPARATUS AND METHOD

[75] Inventors: Stuart K. Neubarth, Mountain View; Alan C. Phillips, Los Altos, both of Calif.; Daniel A. Gerrity, Bellevue, Wash.

[73] Assignee: Coinstar, Inc., Bellevue, Wash.

[21] Appl. No.: 08/882,703

[22] Filed: Jun. 25, 1997

Related U.S. Application Data

[63] Continuation-in-part of application No. 08/807,046, Feb. 24, 1997, abandoned

[60] Provisional application No. 60/012,964, Mar. 7, 1996.

[51] Int. Cl.[7] ..... G07D 5/08

[52] U.S. Cl. ..... 194/317

[58] Field of Search ..... 194/317, 318, 194/319

[56] References Cited

U.S. PATENT DOCUMENTS

| | | | |
|---|---|---|---|
| 466,303 | 2/1891 | Thompson . | |
| 1,234,707 | 7/1917 | Whister | 453/8 X |
| 2,390,147 | 12/1945 | Hatton . | |
| 2,865,561 | 12/1958 | Rosapepe | 232/7 |
| 3,132,654 | 5/1964 | Adams | 133/1 |
| 3,589,492 | 6/1971 | Shirley . | |
| 3,599,771 | 8/1971 | Hinterstocker | 194/318 |
| 3,653,481 | 4/1972 | Boxall et al. . | |
| 3,680,566 | 8/1972 | Tanaka et al. | 133/3 |
| 3,818,918 | 6/1974 | Nissmo et al. . | |
| 3,870,137 | 3/1975 | Fougere . | |
| 3,901,368 | 8/1975 | Klinger . | |
| 3,948,280 | 4/1976 | Dahl et al. . | |
| 3,952,851 | 4/1976 | Fougere et al. . | |
| 4,089,400 | 5/1978 | Gregory, Jr. . | |
| 4,184,366 | 1/1980 | Butler | 194/317 X |
| 4,199,744 | 4/1980 | Aldridge et al. | 336/178 |
| 4,286,704 | 9/1981 | Wood . | |
| 4,334,604 | 6/1982 | Davies . | |
| 4,360,034 | 11/1982 | Davila et al. | 133/3 D |
| 4,380,316 | 4/1983 | Glinka et al. | 232/16 |
| 4,398,550 | 8/1983 | Shireman | 133/1 A |

(List continued on next page.)

FOREIGN PATENT DOCUMENTS

| | | | |
|---|---|---|---|
| 2060630 | 8/1992 | Canada | G06F 15/24 |
| 2067987 | 11/1992 | Canada | G06F 15/21 |
| 0 060 392 A2 | 9/1982 | European Pat. Off. | G07F 3/02 |

(List continued on next page.)

OTHER PUBLICATIONS

Reis Eurosystems, "Operating Instructions CS 3110 Selectronic Coin Sorting and Counting Machine with Central Sensor", Jul. 1992, pp. 1–12, I–IV.

Reis Eurosystems Geldbearbeitungssysteme, "Test—Programme CS 3110 Selectronic coin sorting and counting machine", Jul. 1992, pp. 1–3.

F. Zimmerman & Co., "Reference Manual Contovit/Sortovit, Perconta Money Counting and Sorting Systems", Aug. 1995, pp. I–III, 1–31 and three pages of specifications.

*Primary Examiner*—F. J. Bartuska
*Attorney, Agent, or Firm*—Sheridan Ross P.C.

[57] ABSTRACT

A coin discrimination apparatus and method is provided in which an oscillating electromagnetic field is generated on a single sensing core. The oscillating electromagnetic field is composed on one or more frequency components. The electromagnetic field interacts with a coin, and these interactions are monitored and used to classify the coin according to its physical properties. All frequency components of the magnetic field are phase-locked to a common reference frequency. The phase relationships between the various frequencies are fixed, and the interaction of each frequency component with the coin can be accurately determined without the need for complicated electrical filters or special geometric shaping of the sensing core. In one embodiment, a sensor having a core, preferably ferrite, which is curved, such as in a U-shape or in the shape of a section of a torus, and defining a gap, is provided with a wire winding for excitation and/or detection. The sensor can be used for simultaneously obtaining data relating to two or more parameters of a coin or other object, such as size and conductivity of the object. Two or more frequencies can be used to sense core and/or cladding properties.

19 Claims, 16 Drawing Sheets

U.S. PATENT DOCUMENTS

| | | | |
|---|---|---|---|
| 4,416,365 | 11/1983 | Heiman . | |
| 4,437,558 | 3/1984 | Nicholson et al. . | |
| 4,448,297 | 5/1984 | Mendelsohn . | |
| 4,460,003 | 7/1984 | Barnes et al. . | |
| 4,469,213 | 9/1984 | Nicholson et al. . | |
| 4,471,864 | 9/1984 | Marshall | 194/100 |
| 4,488,116 | 12/1984 | Plesko | 324/236 |
| 4,509,542 | 4/1985 | Watanabe et al. . | |
| 4,509,633 | 4/1985 | Chow . | |
| 4,556,140 | 12/1985 | Okada | 194/206 |
| 4,588,712 | 5/1985 | Sentoku et al. | 133/3 R |
| 4,598,378 | 7/1986 | Giacomo | 364/479 |
| 4,733,765 | 3/1988 | Watanabe | 194/206 |
| 4,753,625 | 6/1988 | Okada | 453/32 |
| 4,754,862 | 7/1988 | Rawicz-Szczerbo et al. | 194/317 X |
| 4,809,838 | 3/1989 | Houserman | 194/317 |
| 4,842,119 | 6/1989 | Abe | 194/317 |
| 4,872,618 | 10/1989 | Sato et al. | 242/4 R |
| 4,883,158 | 11/1989 | Kobayashi et al. | 194/217 |
| 4,884,672 | 12/1989 | Parker | 194/318 |
| 4,914,381 | 4/1990 | Narod | 324/117 R |
| 4,926,997 | 5/1990 | Parker | 194/231 |
| 4,950,986 | 8/1990 | Guerrero | 324/207.19 |
| 4,960,196 | 10/1990 | Kanehara et al. | 194/215 |
| 4,978,322 | 12/1990 | Paulsen | 453/57 |
| 4,995,497 | 2/1991 | Kai et al. | 194/318 |
| 4,995,848 | 2/1991 | Goh | 453/3 |
| 5,030,165 | 7/1991 | Nilsson et al. | 453/9 |
| 5,056,644 | 10/1991 | Parker | 194/318 |
| 5,067,604 | 11/1991 | Metcalf | 194/203 |
| 5,078,252 | 1/1992 | Furuya et al. | 194/318 |
| 5,083,765 | 1/1992 | Kringel | 271/118 |
| 5,091,713 | 2/1992 | Horne et al. | 340/541 |
| 5,131,885 | 7/1992 | Nakao et al. | 453/11 |
| 5,167,571 | 12/1992 | Waller | 453/29 |
| 5,173,851 | 12/1992 | Off et al. | 364/401 |
| 5,191,957 | 3/1993 | Hayes | 194/318 |
| 5,199,545 | 4/1993 | Takamisawa et al. | 194/319 |
| 5,226,520 | 7/1993 | Parker | 194/317 |
| 5,236,074 | 8/1993 | Gotaas | 194/331 |
| 5,244,070 | 9/1993 | Carmen et al. | 194/319 |
| 5,263,566 | 11/1993 | Nara et al. | 194/318 |
| 5,291,782 | 3/1994 | Taylor | 73/319 |
| 5,293,979 | 3/1994 | Levasseur | 194/317 |
| 5,293,980 | 3/1994 | Parker | 194/317 |
| 5,316,120 | 5/1994 | Ibarrola | 194/318 |
| 5,321,242 | 6/1994 | Heath, Jr. | 235/382 |
| 5,323,891 | 6/1994 | Waite | 194/318 |
| 5,326,312 | 7/1994 | Patroni | 453/57 |
| 5,346,049 | 9/1994 | Nakajima et al. | 194/328 |
| 5,351,798 | 10/1994 | Hayes | 194/318 |
| 5,379,875 | 1/1995 | Shames et al. | 194/317 |
| 5,386,901 | 2/1995 | Ibarrola et al. | 194/244 |
| 5,386,902 | 2/1995 | Bointon et al. | 194/346 |
| 5,392,891 | 2/1995 | Ferguson et al. | 194/317 |
| 5,404,985 | 4/1995 | Baughman | 194/242 |
| 5,431,270 | 7/1995 | Wohlrab et al. | 194/318 |
| 5,433,310 | 7/1995 | Bell | 194/318 |
| 5,439,089 | 8/1995 | Parker | 194/317 |
| 5,449,058 | 9/1995 | Kotler et al. | 194/344 |
| 5,452,785 | 9/1995 | Iwamoto et al. | 194/318 |
| 5,458,225 | 10/1995 | Iwamoto et al. | 194/318 |
| 5,460,256 | 10/1995 | Levasseur | 194/334 |
| 5,469,952 | 11/1995 | Kershaw et al. | 194/317 |
| 5,489,015 | 2/1996 | Wood | 194/318 |
| 5,494,145 | 2/1996 | Cohrs et al. | 194/317 |
| 5,494,147 | 2/1996 | Takahashi et al. | 194/328 |
| 5,501,633 | 3/1996 | Watkins et al. | 453/17 |
| 5,515,960 | 5/1996 | Wood | 194/328 |

FOREIGN PATENT DOCUMENTS

| | | | |
|---|---|---|---|
| 209 357 | 1/1987 | European Pat. Off. . | |
| 0 300 781 | 1/1989 | European Pat. Off. | G07D 5/08 |
| 1 944 488 | 3/1971 | Germany . | |
| 25 16 532 A1 | 10/1975 | Germany | G07D 7/00 |
| 288 018 | 3/1991 | Germany | G07F 3/02 |
| 1-307891 | 12/1989 | Japan . | |
| 3-63795 | 3/1991 | Japan . | |
| 2 198 274 | 6/1988 | United Kingdom | G07D 3/00 |
| 87/00102 | 9/1987 | WIPO | G07D 3/02 |
| 88/00274 | 10/1988 | WIPO | G07D 3/12 |
| 88/00592 | 2/1989 | WIPO | G07D 5/08 |
| 93/07846 | 4/1994 | WIPO | G06F 15/16 |

COIN SENSING APPARATUS AND METHOD

This application is a continuation-in-part of U.S. patent application Ser. No. 08/807,046, filed Feb. 24, 1997 now abandoned and of Provisional Patent Application S. No. 60/012,964, filed Mar. 7, 1996.

The present invention relates to an apparatus for sensing coins and other small discrete objects, and in particular to a sensor which may be used in a coin counting or handling device.

BACKGROUND INFORMATION

A number of devices require sensors which can identify and/or discriminate coins or other small discrete objects. Examples include coin counting or handling devices, (such as those described in U.S. patent applications Ser. Nos. 08/255,539, 08/237,486, and 08/431,070, all of which are incorporated herein by reference) vending machines, gaming devices such as slot machines, bus or subway coin or token "fare boxes," and the like. Preferably, for such purposes, the sensors provide information which can be used to discriminate coins from non-coin objects and/or which can discriminate among different coin denominations and/or discriminate coins of one country from those of another.

Previous sensors and coin handling devices, however, have suffered from a number of deficiencies. Many previous sensors have resulted in an undesirably large proportion of discrimination errors. At least in some cases this is believed to arise from an undesirably small signal to noise ratio in the sensor output. Accordingly, it would be useful to provide coin discrimination sensors having improved signal to noise ratio.

Many previous coin sensors were configured for use in devices which receive only one coin at a time, such as a typical vending machine which receives a single coin at a time through a coin slot. These devices typically present an easier sensing environment because there is a lower expectation for coin throughput, an avoidance of the deposit of foreign material, an avoidance of small inter-coin spacing (or coin overlap), and because the slot naturally defines maximum coin diameter and thickness. Sensors that might be operable for a one-at-a-time coin environment may not be satisfactory for an environment in which a mass or plurality of coins can be received in a single location, all at once (such as a tray for receiving a mass of coins, poured into the tray from, e.g., a coin jar). Accordingly it would be useful to provide a sensor which, although it might be successfully employed in a one-coin-at-a-time environment, can also function satisfactorily in a device which receives a mass of coins.

Many previous sensors used for coin discrimination were configured to sense characteristics or parameters of coins (or other objects) so as to provide data relating to an average value for a coin as a whole. Such sensors were not able to provide information specific to certain regions or levels of the coin (such as core material vs. cladding material). In some currencies, two or more denominations may have average characteristics which are so similar that it is difficult to distinguish the coins. For example, it is difficult to distinguish U.S. dimes from pre-1982 U.S. pennies, based only on average differences, the main physical difference being the difference in cladding (or absence thereof). In some previous devices, inductive coin testing is used to detect the effect of a coin on an alternating electromagnetic field produced by a coil, and specifically the coin's effect upon the coil's impedance, e.g. related to one or more of the coin's diameter, thickness, conductivity and permeability. In general, when an alternating electromagnetic field is provided to such a coil, the field will penetrate a coin to an extent that decreases with increasing frequency. Properties near the surface of a coin have a greater effect on a higher frequency field, and interior material have a lesser effect. Because certain coins, such as the United States ten and twenty-five cent coins, are laminated, this frequency dependency can be of use in coin discrimination. Accordingly, it would further be useful to provide a device which can provide information relating to different regions of coins or other objects.

Although there are a number of parameters which, at least theoretically, can be useful in discriminating coins and small objects (such as size, including diameter and thickness), mass, density, conductivity, magnetic permeability, homogeneity or lack thereof (such as cladded or plated coins), and the like, many previous sensors were configured to detect only a single one of such parameters. In embodiments in which only a single parameter is used, discrimination among coins and other small objects was often inaccurate, yielding both misidentification of a coin denomination (false positives), and failure to recognize a coin denomination (false negatives). In some cases, two coins which are different may be identified as the same coin because a parameter which could serve to discriminate between the coins (such as presence or absence of plating, magnetic non-magnetic character of the coin, etc.) is not detected by the sensor. Thus, using such sensors, when it is desired to use several parameters to discriminate coins and other objects, it has been necessary to provide a plurality of sensors (if such sensors are available), typically one sensor for each parameter to be detected. Multiplying the number of sensors in a device increases the cost of fabricating, designing, maintaining and repairing such apparatus. Furthermore, previous devices typically required that multiple sensors be spaced apart, usually along a linear track which the coins follow, and often the spacing must be relatively far apart in order to properly correlate sequential data from two sensors with a particular coin (and avoid attributing data from the two sensors to a single coin when the data was related, in fact, to two different coins). This spacing increases the physical size requirements for such a device, and may lead to an apparatus which is relatively slow since the path which the coins are required to traverse is longer.

Furthermore, when two or more sensors each output a single parameter, it is typically difficult or impossible to base discrimination on the relationship or profile of one parameter to a second parameter for a given coin, because of the difficulty in knowing which point in a first parameter profile corresponds to which point in a second parameter profile. If there are multiple sensors spaced along the coin path, the software for coin discrimination becomes more complicated, since it is necessary to keep track of when a coin passes by the various sensors. Timing is affected, e.g., by speed variations in the coins as they move along the coin path, such as rolling down a rail.

Even in cases where a single core is used for two different frequencies or parameters, many previous devices take measurements at two different times, typically as the coin moves through different locations, in order to measure several different parameters. For example, in some devices, a core is arranged with two spaced-apart poles with a first measurement taken at a first time and location when a coin is adjacent a first pole, and a second measurement taken at a second, later time, when the coin has moved toward the second pole. It is believed that, in general, providing two or more different measurement locations or times, in order to measure two or more parameters, or in order to use two or more frequencies, leads to undesirable loss of coin throughput, occupies undesirably extended space and requires relatively complicated circuits and/or algorithms (e.g. to match up sensor outputs as a particular coin moves to different measurement locations).

Some sensors relate to the electrical or magnetic properties of the coin or other object, and may involve creation of an electromagnetic field for application to the coin. With many previous sensors, the interaction of generated magnetic flux with the coin was too low to permit the desired efficiency and accuracy of coin discrimination, and resulted in an insufficient signal-to-noise ratio.

Accordingly, it would be advantageous to provide a sensor or coin handler/sensor device having improved discrimination, reduced costs or space requirements, which is faster than previous devices and/or results in improved signal-to-noise ratio.

SUMMARY OF THE INVENTION

According to the present invention, a sensor is provided in which nearly all the magnetic field produced by the coil interacts with the coin providing a relatively intense electromagnetic field in the region traversed by a coin or other object. Preferably, the sensor can be used to obtain information on two different parameters of a coin or other object. In one embodiment, a single sensor provides information indicative of both size, (diameter) and conductivity. In one embodiment, the sensor includes a core, such as a ferrite or other magnetically permeable material, in a curved (e.g., torroid or half-torroid) shape which defines a gap. The coin being sensed moves through the vicinity of the gap, in one embodiment, through the gap. The gap may be formed between opposed faces of a torroid section, or formed between the opposed and spaced edges of two plates, coupled (such as by adhesion) to faces of a section of a torroid. In either configuration, a single continuous non-linear core has first and second ends, with a gap therebetween.

Although it is possible to provide a sensor in which the core is driven by a direct current, preferably, the core is driven by an alternating or varying current. As a coin or the object passes through the field in the vicinity of the gap, data relating to coin parameters are sensed, such as changes in inductance (from which the diameter of the object or coin, or portions thereof, can be derived), and the qualify factor (Q factor), related to the amount of energy dissipated (from which conductivity of the object or coin (or portions thereof) can be obtained). In one embodiment, data relating to conductance of the coin (or portions thereof) as a function of diameter are analyzed (e.g. by comparing with conductance-diameter data for known coins) in order to discriminate the sensed coins.

According to one aspect of the invention, a coin discrimination apparatus and method is provided in which an oscillating electromagnetic field is generated on a single sensing core. The oscillating electromagnetic field is composed on one or more frequency components. The electromagnetic field interacts with a coin, and these interactions are monitored and used to classify the coin according to its physical properties. All frequency components of the magnetic field are phase-locked to a common reference frequency. The phase relationships between the various frequencies are fixed, and the interaction of each frequency component with the coin can be accurately determined without the need for complicated electrical filters or special geometric shaping of the sensing core.

In one embodiment two or more frequencies are used. Preferably, to reduce the number of sensors in the devices, both frequencies drive a single core. In this way, a first frequency can be selected to obtain parameters relating to the core of a coin and a second frequency selected to obtain parameters relating to the skin region of the coin, e.g., to characterize plated or laminated coins. One difficulty in using two or more frequencies on a single core is the potential for interference. In one embodiment, to avoid such interference both frequencies are phase locked to a single reference frequency. In one approach, the sensor forms an inductor of an L-C oscillator, whose frequency is maintained by a Phase-Locked Loop (PLL) to define an error signal (related to Q) and amplitude which change as the coin moves past the sensor.

As seen in FIGS. 2A, 2B, 3 and 4, the depicted sensor includes a coil which will provide a certain amount of inductance or inductive reactance in a circuit to which it is connected. The effective inductance of the coil will change as, e.g. a coin moves adjacent or through the gap and this change of inductance can be used to at least partially characterize the coin. Without wishing to be bound by any theory, it is believed the coin or other object affects inductance in the following manner. As the coin moves by or across the gap, the AC magnetic field lines are altered. If the frequency of the varying magnetic field is sufficiently high to define a "skin depth" which is less than about the thickness of the coin, no field lines will go through the coin as the coin moves across or through the gap. As the coin is moved across or into the gap, the inductance of a coil wound on the core decreases, because the magnetic field of the direct, short path is canceled (e.g., by eddy currents flowing in the coin). Since, under these conditions no flux goes through any coin having any substantial conductivity, the decrease in inductance due to the presence of the coin is primarily a function of the surface area (and thus diameter) of the coin.

A relatively straightforward approach would be to use the coil as an inductor in a resonant circuit such as an LC oscillator circuit and detect changes in the resonant frequency of the circuit as the coin moved past or through the gap. Although this approach has been found to be operable and to provide information which may be used to sense certain characteristics of the coin (such as its diameter) a more preferred embodiment is shown, in general form, in FIG. 5 and is described in greater detail below. In the embodiment of FIG. 5, the coil 502 forms a part of an oscillator circuit such as an LC oscillator 504. The circuit is configured to maintain oscillation of the signal through the coil 502 at a substantially constant frequency, even as the effective inductance of the coil 502 changes (e.g. in response to passage of a coin). The amount of change in other components of the circuit needed to offset the change in inductance 502 (and thus maintain the frequency at a substantially constant value) is a measure of the magnitude of the change in the inductance 502 caused by the passage of the coin. In the embodiment of FIG. 5, a phase detector 506 compares a signal indicative of the frequency in the oscillator 508 with a reference frequency 510 and outputs an error signal 512 which controls a frequency-varying component of the oscillator 514 (such as a variable capacitor). The magnitude of the error signal 512 is an indication of the magnitude of the change in the effective inductance of the coil 502. The detection configuration shown in FIG. 5 is thus capable of detecting changes in inductance (related to the coin diameter) while maintaining the frequency of the oscillator substantially constant. Providing a substantially constant frequency is useful because, among other reasons, the sensor will be less affected by interfering electromagnetic fields than a sensor that allows the frequency to shift would be. It will also be easier to prevent unwanted electromagnetic radiation from the sensor, since filtering or shielding would be provided only with respect to one frequency as opposed to a range of frequencies.

In addition to providing information related to coin diameter, the sensor can also be used to provide information related to coin conductance, preferably substantially simultaneously with providing the diameter information. FIG. 6 provides a simplified block diagram of one method for obtaining a signal related to conductance. As a coin moves past the coil 502, there will be an amount of energy loss and the amplitude of the signal in the coil will change in a manner related to the conductance of the coin (or portions thereof). Without wishing to be bound by any theory, it is believed that the presence of the coin affects energy loss, as indicated by the Q factor in the following manner. As noted above, as the coin moves past or through the gap, eddy currents flow causing an energy loss, which is related to both the amplitude of the current and the resistance of the coin. The amplitude of the current is substantially independent of coin conductivity (since the magnitude of the current is always enough to cancel the magnetic field that is prevented by the presence of the coin). Therefore, for a given effective diameter of the coin, the energy loss in the eddy currents will be inversely related to the conductivity of the coin. The relationship can be complicated by such factors as the skin depth, which affects the area of current flow with the skin depth being related to conductivity.

Thus, for a coil 502 driven at a first, e.g. sinusoidal, frequency, the amplitude can be determined by using timing signals 602 (FIG. 6) to sample the voltage at a time known to correspond to the peak voltage in the cycle, using a first sampler 606 and sampling at a second point in the cycle known to correspond to the trough using a second sampler 608. The sampled (and held) peak and trough voltages can be provided to a differential amplifier 610, the output of which 612 is related to the conductance. More precisely speaking, the output 612 will represent the Q of the circuit. In general, Q is a measure of the amount of energy loss in an oscillator. In a perfect oscillator circuit, there would be no energy loss (once started, the circuit would oscillate forever) and the Q value would be infinite. In a real circuit, the amplitude of oscillations will diminish and Q is a measure of the rate at which the amplitude diminishes. In another embodiment, data relating to changes in frequency as a function of changes in Q are analyzed (or correlated with data indicative of this functional relationship for various types of coins or other objects).

In one embodiment, the invention involves combining two or more frequencies on one core by phase-locking all the frequencies to the same reference. Because the frequencies are phase-locked to each other, the interference effect of one frequency on the others becomes a common-mode signal, which is removed, e.g., with a differential amplifier.

In one embodiment, a coin discrimination apparatus and method is provided in which an oscillating electromagnetic field is generated on a single sensing core. The oscillating electromagnetic field is composed of one or more frequency components. The electromagnetic field interacts with a coin, and these interactions are monitored and used to classify the coin according to its physical properties. All frequency components of the magnetic field are phase-locked to a common reference frequency. The phase relationships between the various frequencies are fixed, and the interaction of each frequency component with the coin can be accurately determined without the need for complicated electrical filters or special geometric shaping of the sensing core. In one embodiment, a sensor having a core, preferably ferrite, which is curved (or otherwise non-linear), such as in a U-shape or in the shape of a section of a torus, and defining a gap, is provided with a wire winding for excitation and/or detection. The sensor can be used for simultaneously obtaining data relating to two or more parameters of a coin or other object, such as size and conductivity of the object. Two or more frequencies can be used to sense core and/or cladding properties.

DETAILED DESCRIPTION OF THE PREFERRED EMBODIMENTS

Figure 1:
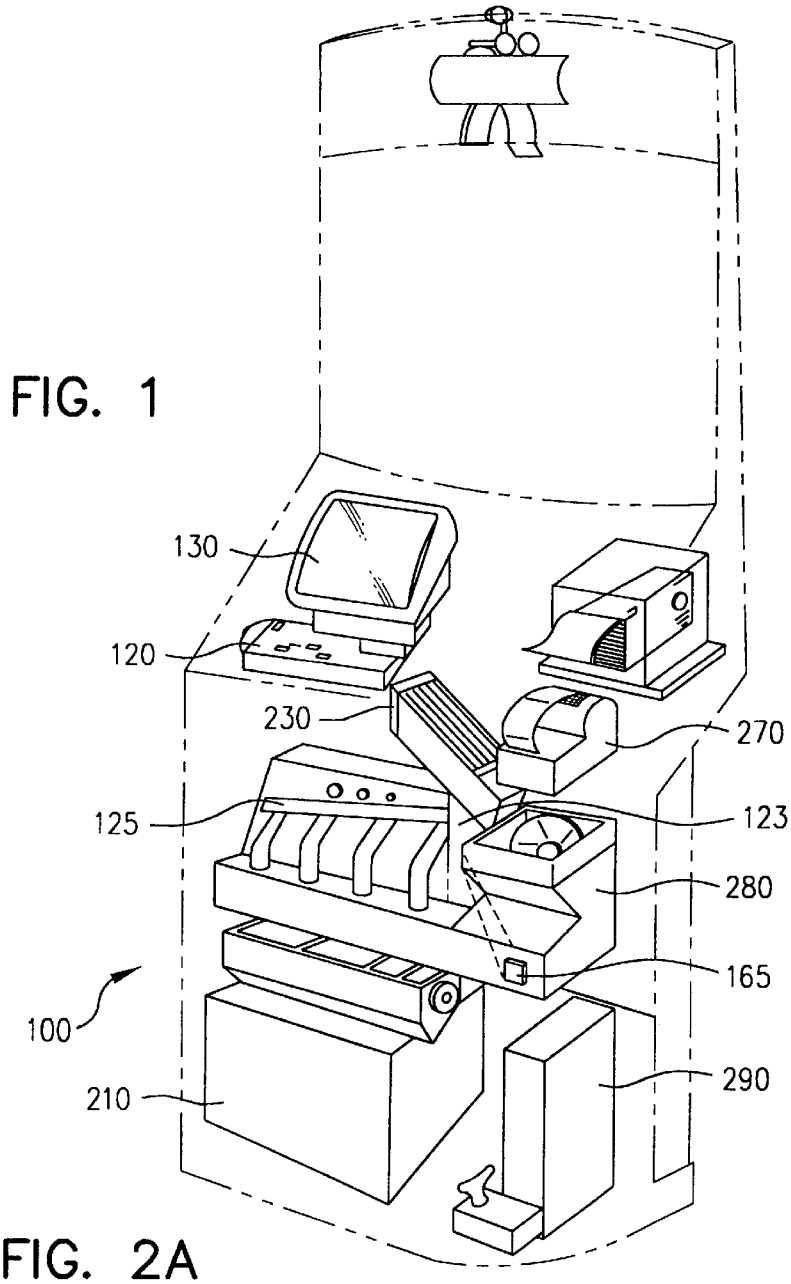
FIG. 1 depicts a coin handling apparatus.

The sensor and associated apparatus described herein can be used in connection with a number of devices and purposes. One device is illustrated in FIG. 1. In this device, coins are placed into a tray 120, and fed to a sensor region 123 via a first ramp 230 and hopper 280. In the sensor region 123, data is collected by which coins are discriminated from non-coin objects, and different denominations or countries of coins are discriminated. The data collected in the sensor area 123 is used by the computer at 290 to control movement of coins along a second ramp 125 in such a way as to route the coins into one of a plurality of bins 210. The computer may output information such as the total value of the coins placed into the tray, via a printer 270, screen 130, or the like. In the depicted embodiment, the conveyance apparatus 230, 280 which is upstream of the sensor region 123 provides the coins to the sensor area 123 serially, one at a time.

In one embodiment, a sensor includes first and second ferrite cores, each substantially in the shape of a section of a torrus 282*a, b* (FIG. 2D), said first core defining a first gap 284*a*, and said second core defining a second gap 284*b*, said cores positioned with said gaps aligned 286 so that a coin conveyed by said counting device will move through said first and second gaps; at least first and second coils 288*a, b* of conductive material wound about a first portion of each of said first and second cores, respectively; an oscillator 292 a coupled to said first coil 288*a* configured to provide current defining at least a first frequency defining a first skin depth less than said cladding thickness and wherein, when a coin is conveyed past said first gap 282*a*, the signal in said coil undergoes at least a first change in inductance and a change in the quality factor of said inductor; an oscillator 292*b* coupled to said second coil 288*b* configured to provide current defining at least a second frequency defining a second skin depth greater than said first skin depth wherein, when said coin is conveyed past said second gap 284*b*, the signal in said coil undergoes at least a second change in inductance and a second change in the quality factor of said inductor; and a processor 294 configured to receive data indicative of said first and second changes in inductance and changes in quality factor to permit separate characterization of said cladding and said core.

Figure 2A:
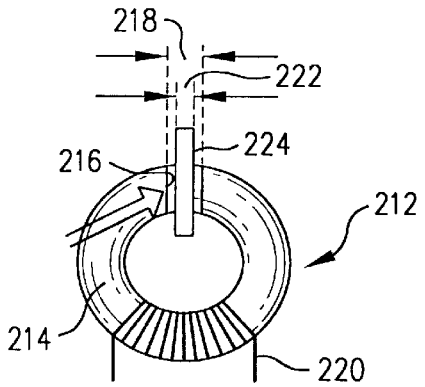
FIG. 2A is a front elevational view of a sensor and adjacent coin, according to an embodiment of the present invention.

As depicted in FIG. 2A, in one embodiment a sensor, 212 includes a core 214 having a generally curved shape and defining a gap 216, having a first width 218. In the depicted embodiment, the curved core is a torroidal section. Although "torroidal" includes a locus defined by rotating a circle about a non-intersecting coplanar line, as used herein, the term "torroidal" generally means a shape which is curved or otherwise non-linear. Examples include a ring shape, a U shape, a V shape or a polygon. In the depicted embodiment both the major cross section (of the shape as a whole) and the minor cross section (of the generating form) have a circular shape. However, other major and minor cross-sectional shapes can be used, including elliptical or oval shapes, partial ellipses, ovals or circles (such as a semi-circular shape), polygonal shapes (such as a regular or irregular hexagon/octagon, etc.), and the like.

The core 214 may be made from a number of materials provided that tie material is capable of providing a substantial magnetic field in the gap 216. In one embodiment, the core 214 consists of, or includes, a ferrite material, such as formed by fusing ferric oxide with another material such as a carbonate hydroxide or alkaline metal chloride, a ceramic ferrite, and the like. If the core is driven by an alternating current, the material chosen for the core of the inductor, should be normal-loss or low-loss at the frequency of oscillation such that the "no-coin" Q of the LC circuit is substantially higher than the Q of the LC circuit with a coin adjacent the sensor. This ratio determines, in part, the signal-to-noise ratio for the coin's conductivity measurement. The lower the losses in the core and the winding, the greater the change in eddy current losses, when the coin is placed in or passes by the gap, and thus the greater the sensitivity of the device. In the depicted embodiment, a conductive wire 220 is wound about a portion of the core 214 so as to form an inductive device. Although FIG. 2A depicts a single coil, in some embodiments, two or more coils may be used, e.g. as described below. In the depicted embodiment, the coin or other object to be discriminated is positioned in the vicinity of the gap (in the depicted embodiment, within the gap 216). Thus, in the depicted embodiment the gap width 218 is somewhat larger than the thickness 222 of the thickest coin to be sensed by the sensor 212, to allow for mis-alignment, movement, deformity, or dirtiness of the coin. Preferably, the gap 216 is as small as possible, consistent with practical passage of the coin. In one embodiment, the gap is about 4 mm.

Figure 2B:
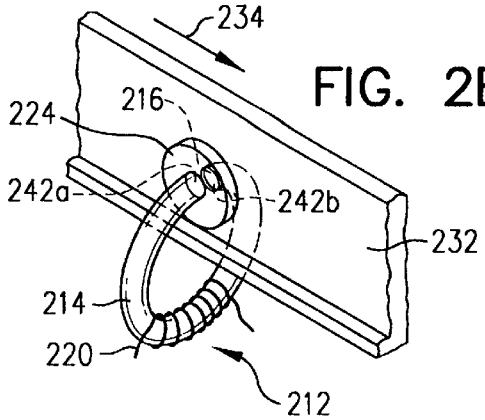
FIGS. 2B and 2C are perspective views of sensors and coin-transport rail according to embodiments of the present invention.

FIG. 2B depicts a sensor 212', positioned with respect to a coin conveying rail 232, such that, as the coin 224 moves down the rail 234, the rail guides the coin 214 through the gap 216 of the sensor 212'. Although FIG. 2B depicts the coin 214 traveling in a vertical (on-edge) orientation, the device could be configured so that the coin 224 travels in other orientations, such as in a lateral (horizontal) configuration or angles therebetween. One of the advantages of the present invention is the ability to increase speed of coin movement (and thus throughput) since coin discrimination can be performed rapidly. This feature is particularly important in the present invention since coins which move very rapidly down a coin rail have a tendency to "fly" or move partially and/or momentarily away from the rail. The present invention can be configured such that the sensor is relatively insensitive to such departures from the expected or nominal coin position. Thus, the present invention contributes to the ability to achieve rapid coin movement not only by providing rapid coin discrimination but insensitivity to coin "flying." Although FIG. 2B depicts a configuration in which the coin 224 moves down the rail 232 in response to gravity, coin movement can be achieved by other unpowered or powered means such as a conveyor belt. Although passage of the coin through the gap 216 is depicted, in another embodiment the coin passes across, but not through the gap (e.g. as depicted with regard to the embodiment of FIG. 4).

Figure 3:
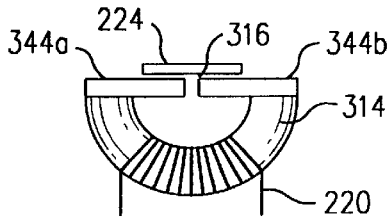
FIG. 3 is a front elevational view of a sensor and adjacent coin, according to another embodiment of the present invention.
Figure 4:
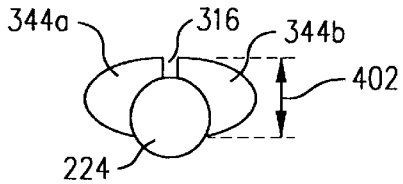
FIG. 4 is a top plan view of the sensor of FIG. 3.

FIG. 3 depicts a second configuration of a sensor, in which the gap 316, rather than being formed by opposed faces 242*a*, 242*b*, of the core 214 is, instead, formed between opposed edges of spaced-apart plates (or "pole pieces") 344*a*, 344*b*, which are coupled to the core 314. In this configuration, the core 314 is a half-torus. The plates 344*a*, 344*b*, may be coupled to a torroid in a number of fashions, such as by using an adhesive, cement or glue, a pressfit, spotwelding, or brazing, riveting, screwing, and the like. Although the embodiment depicted in FIG. 3 shows the plates 344*a*, 344*b* attached to the torroid 314, it is also possible for the plates and torroid to be formed integrally. As seen in FIG. 4, the plates 344*a*, 344*b*, may have half-oval shapes, but a number of other shapes are possible, including semi-circular, square, rectangular, polygonal, and the like. In the embodiment of FIGS. 3 and 4, the field-concentrating effect of ferrite can be used to produce a very localized field for interaction with a coin, thus reducing or eliminating the effect of a touching neighbor coin. The embodiment of FIGS. 3 and 4 can also be configured to be relatively insensitive to the effects of coin "flying" and thus contribute to the ability to provide rapid coin movement and increase coin throughput. Although the percentage of the magnetic field which is affected by the presence of a coin will typically be less in the configuration of FIGS. 3 and 4, than in the configuration of FIG. 2, satisfactory results can be obtained if the field changes are sufficiently large to yield a consistently high signal-to-noise indication of coin parameters. Preferably the gap 316 is sufficiently small to produce the desired magnetic field intensity in or adjacent to the coin, in order to expose the coin to an intense field as it passes by and/or through the gap 316. In the embodiment of FIG. 4, the length of the gap 402 is large enough so that coins with different diameters cover different proportions of the gap.

The embodiment of FIG. 3 and 4 is believed to be particularly useful in situations in which it is difficult or impossible to provide access to both faces of a coin at the same time. For example, if the coin is being conveyed on one of its faces rather than on an edge (e.g., being conveyed on a conveyor belt or a vacuum belt). Furthermore, in the embodiment of FIGS. 3 and 4, the gap 316 does not need to be wide enough to accommodate the thickness of the coin and can be made quite narrow such that the magnetic field to which the coin is exposed is also relatively narrow. This configuration can be useful in avoiding an adjacent or "touching" coin situation since, even if coins are touching, the magnetic field to which the coins are exposed will be too narrow to substantially influence more than one coin at a time (during most of a coin's passage past the sensor).

When an electrical potential or voltage is applied to the coil 220, a magnetic field is created in the vicinity of the gap 216, 316 (i.e. created in and near the gap 216, 316). The interaction of the coin or other object with such a magnetic field (or lack thereof) yields data which provides information about parameters of the coin or object which can be used for discrimination, e.g. as described more thoroughly below.

In one embodiment, current in the form of a variable or alternating current (AC) is supplied to the coil 220. Although the form of the current may be substantially sinusoidal as used herein "AC" is meant to include any variable (non-constant) wave form, including ramp, sawtooth, square waves, and complex waves such as wave forms which are the sum or two or more sinusoidal waves. Because of the configuration of the sensor, and the positional relationship of the coin or object to the gap, the coin can be exposed to a significant magnetic field, which can be significantly affected by the presence of the coin. The sensor can be used to detect these changes in the electromagnetic field, as the coin passes over or through the gap, preferably in such as way as to provide data indicative of at least two different parameters of the coin or object. In one embodiment, a parameter such as the size or diameter of the coin or object is indicated by a change in inductance, due to the passage of the coin, and the conductivity of the coin or object is (inversely) related to the energy loss (which may be indicated by the quality factor or "Q.")

Figure 15A:
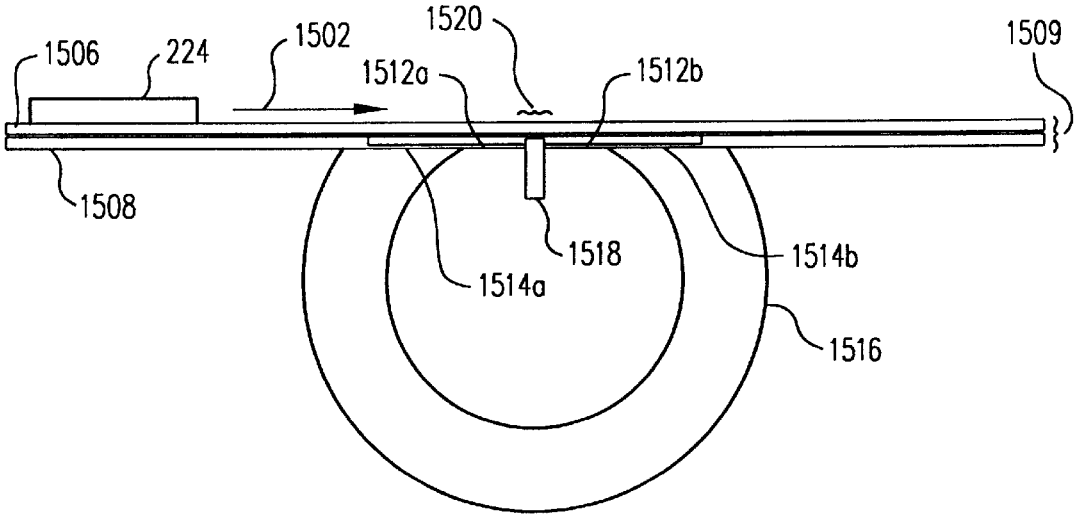
FIGS. 15A and 15B are front elevational and top plan views of a sensor, coin path and coin, according to an embodiment of the present invention.
Figure 15B:
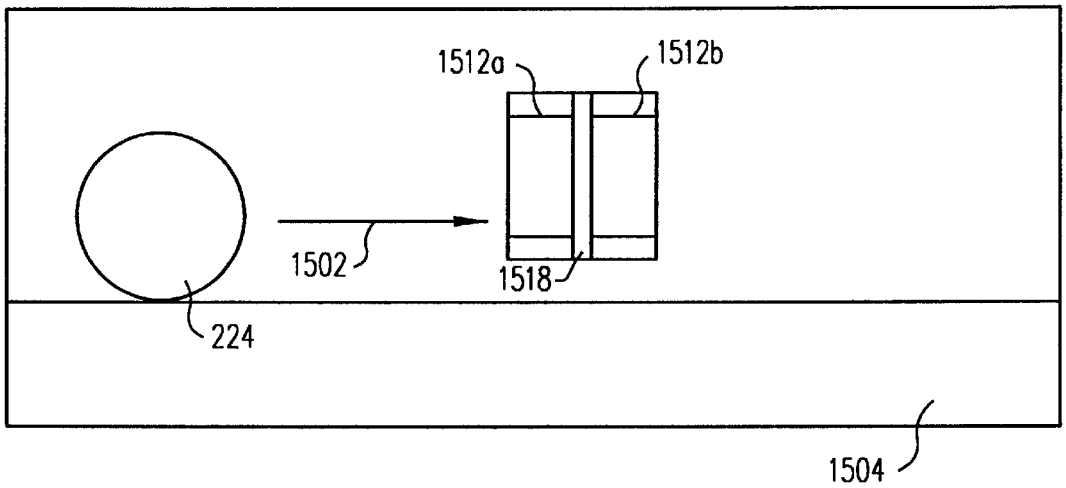
Figure 16A:
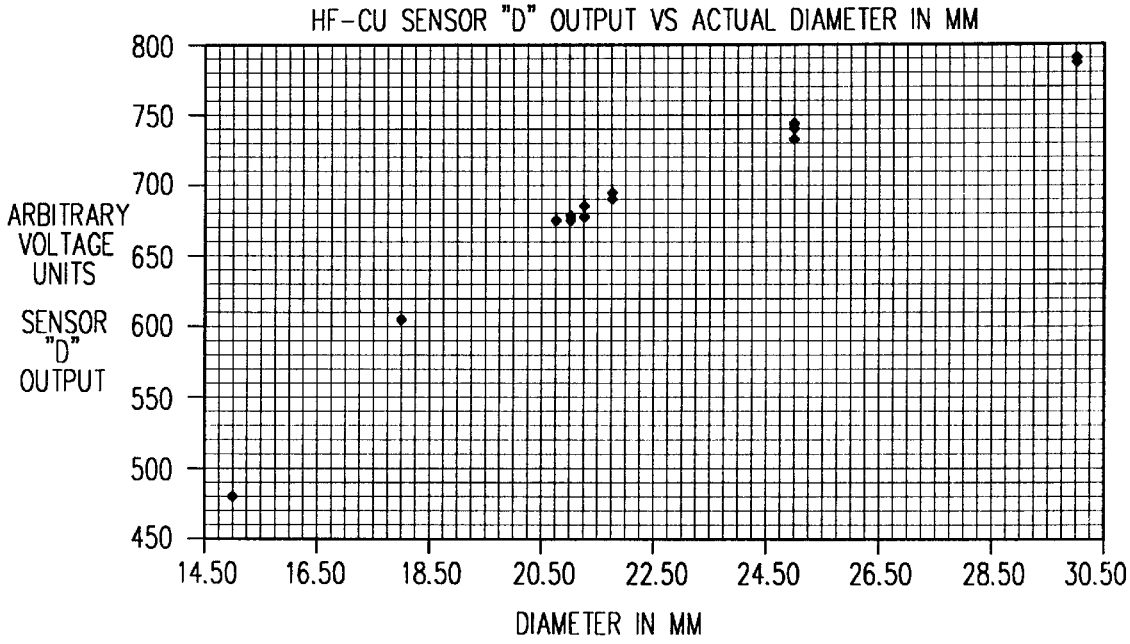
FIGS. 16A and 16B are graphs showing D output from high and low frequency sensors, respectively, for eight copper and aluminum disks of various diameters, according to an embodiment of the present invention.
Figure 16B:
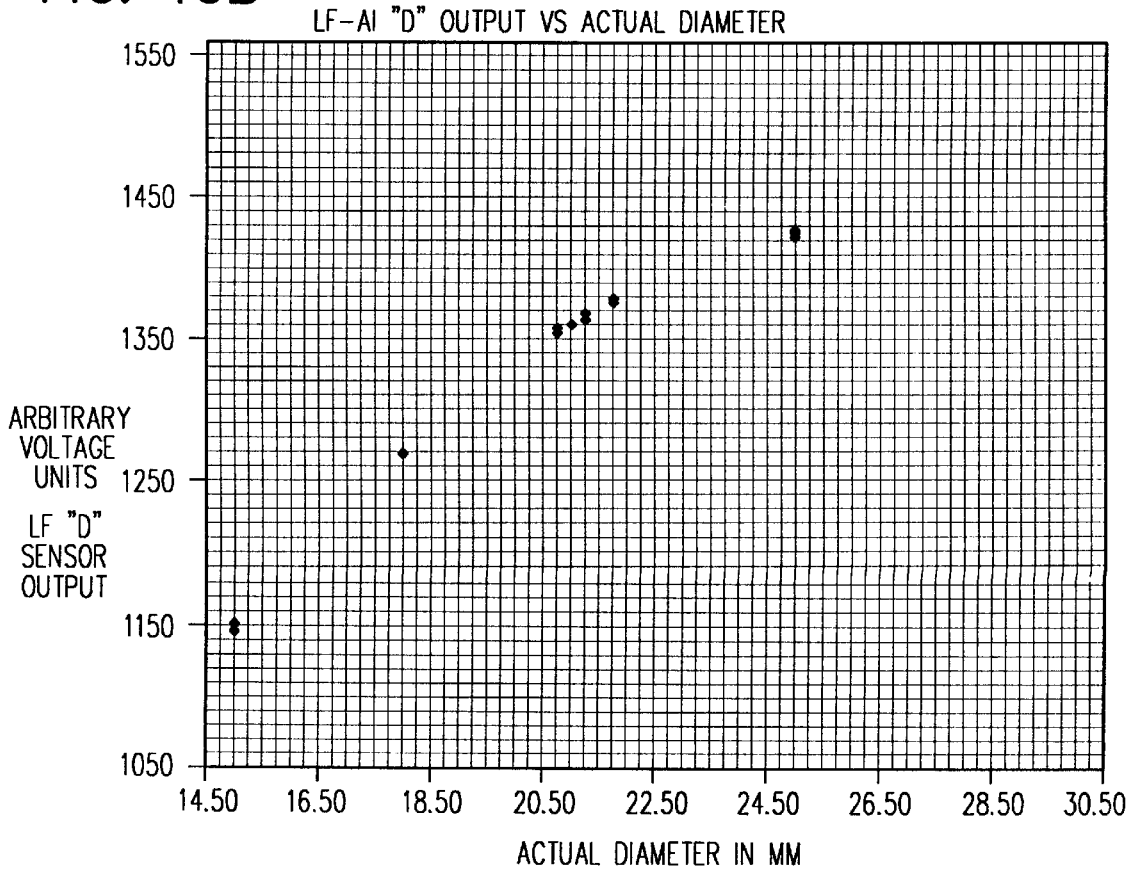

FIGS. 15A and 15B depict an embodiment which provides a capability for capacitive sensing, e.g. for detecting or compensating for coin relief and/or flying. In the embodiment of FIGS. 15A and 15B, a coin 224 is constrained to move along a substantially linear coin path 1502 defined by a rail device such as a polystyrene rail 1504. At least a portion of the coin path is adjacent a two-layer structure having an upper layer which is substantially non-electrically conducting 1506 such as fiberglass and a second layer 1508 which is substantially conductive such as copper. The two-layer structure 1506, 1508 can be conveniently provided by ordinary circuit board material 1509 such as 1/23 inch thick circuit board material with the fiberglass side contacting the coin as depicted. In the depicted embodiment, a rectangular window is formed in the copper cladding or layer 1508 to accommodate rectangular ferrite plates 1512*a*, 1512*b* which are coupled to faces 1514*a*, 1514*b* of the ferrite torroid core 1516. A conductive structure such as a copper plate or shield 1518 is positioned within the gap 1520 formed between the ferrite plates 1512*a*, 1512*b*. The shield is useful for increasing the flux interacting with the coin. Without wishing to be bound by any theory, it is believed that such a shield 1518 has the effect of forcing the flux to go around the shield and therefore to bulge out more into the coin path in the vicinity of the gap 1520 which is believed to provide more flux interacting with the coin than without the shield (for a better signal-to-noise ratio). The shield 1518 can also be used as one side of a capacitive sensor, with the other side being the copper backing/ground plane 1508 of the circuit board structure 1509. Capacitive changes sensed between the shield 1518 and the ground plane 1508 are believed to be related to the relief of the coin adjacent the gap 1520 and the distance to the coin.

Figure 5:
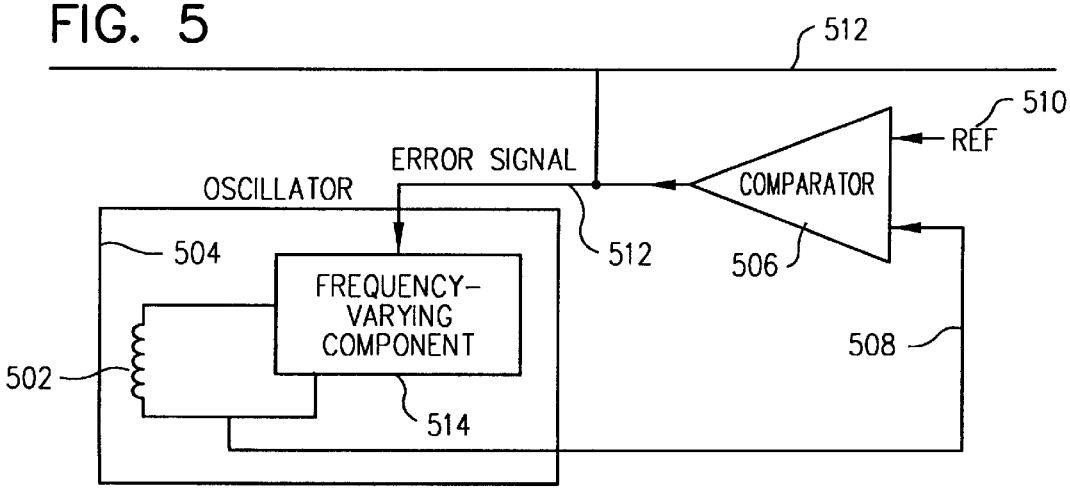
FIG. 5 is a block diagram of a discrimination device according to an embodiment of the present invention.
Figure 6:
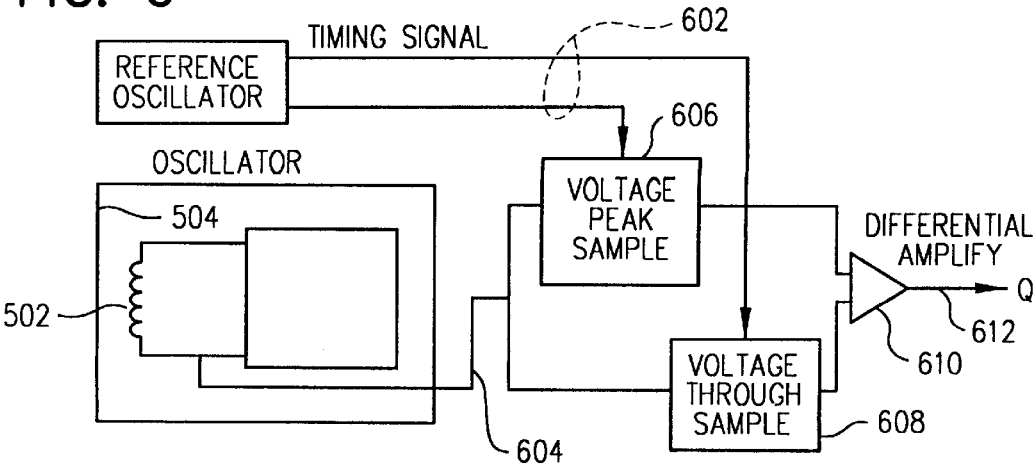
FIG. 6 is a block diagram of a discrimination device according to an embodiment of the present invention.

In the embodiment of FIG. 5, the output of signal 512 is related to change in inductance, and thus to coin diameter which is termed "D." The configuration of FIG. 6 results in the output of a signal 612 which is related to Q and thus to conductivity, termed, in FIG. 6, "Q." Although the D signal is not purely proportional to diameter (being at least somewhat influenced by the value of Q) and Q is not strictly and linearly proportional to conductance (being somewhat influenced by coin diameter) there is a sufficient relationship between signal D 512 and coin diameter and between signal Q 612 and conductance that these signals, when properly analyzed, can serve as a basis for coin discrimination. Without wishing to be bound by any theory, it is believed that the interaction between Q and D is substantially predictable and is substantially linear over the range of interest for a coin-counting device.

Figure 9:
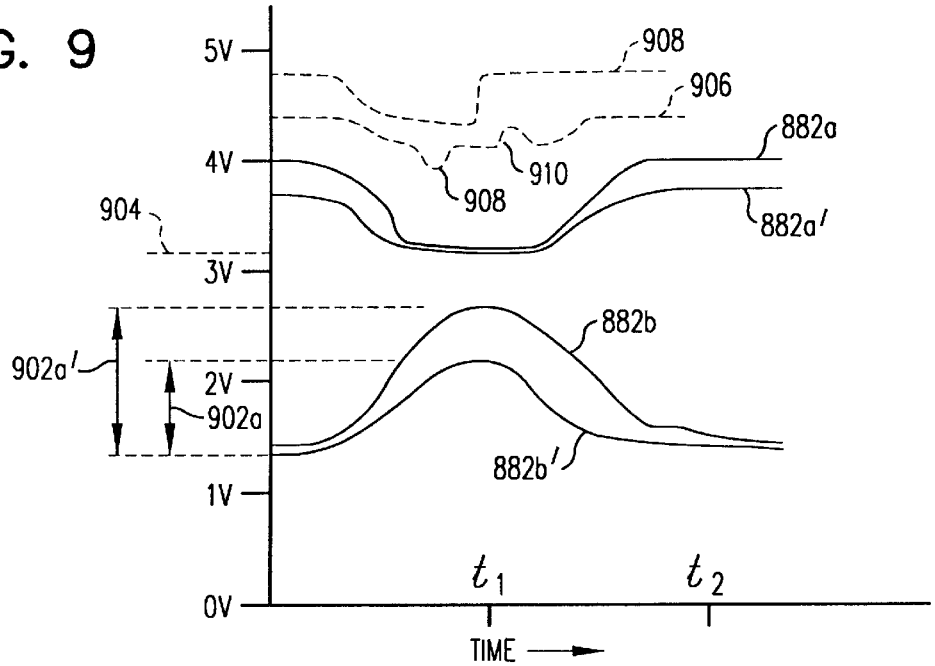
FIG. 9 depicts an example of output signals of a type output by the circuit of FIGS. 8A–D as a coin passes the sensor.
Figure 11:
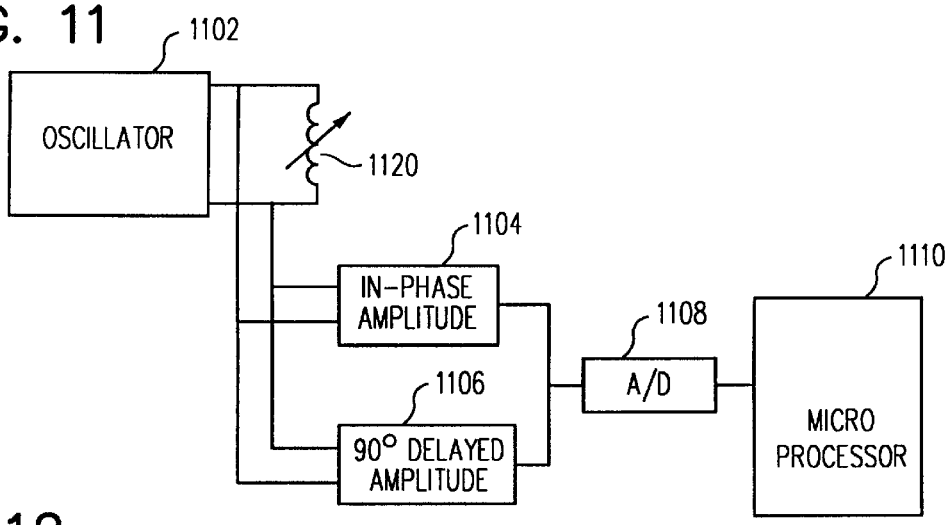
FIG. 11 is a block diagram of a discrimination device, according to an embodiment of the present invention.

Many methods and/or devices can be used for analyzing the signals 512, 612, including visual inspection of an oscilloscope trace or graph (e.g. as shown in FIG. 9), automatic analysis using a digital or analog circuit and/or a computing device such as a microprocessor-based computer and/or using a digital signal processor (DSP). When it is desired to use a computer, it is useful to provide signals 512 and 612 (or modify those signals) so as to have a voltage range and/or other parameters compatible with input to a computer. In one embodiment, signals 512 and 612 will be voltage signals normally lying within the range 0 to +5 volts.

In some cases, it is desired to separately obtain information about coin parameters for the interior or core portion of the coin and the exterior or skin portion, particularly in cases where some or all of the coins to be discriminated may be cladded, plated or coated coins. For example, in some cases it may be that the most efficient and reliable way to discriminate between two types of coins is to determine the presence or absence of cladding or plating, or compare a skin or core parameter with a corresponding skin or core parameter of a known coin. In one embodiment, different frequencies are used to probe different depths in the thickness of the coin. This method is effective because, in terms of the interaction between a coin and a magnetic field, the frequency of a variable magnetic field defines a "skin depth," which is the effective depth of the portion of the coin or other object which interacts with the variable magnetic field. Thus, in this embodiment, a first frequency is provided which is relatively low to provide for a larger skin depth, and thus interaction with the core of the coin or other object, and a second, higher frequency is provided, high enough to result in a skin depth substantially less than the thickness of the coin. In this way, rather than a single sensor providing two parameters, the sensor is able to provide four parameters: core conductivity; cladding or coating conductivity; core diameter; and cladding or coating diameter (although it is anticipated that, in many instances, the core and cladding diameters will be similar). Preferably, the low-frequency skin depth is greater than the thickness of the plating or lamination, and the high frequency skin depth is less than, or about equal to, the plating or lamination thickness (or the range of lamination depths, for the anticipated coin population). Thus the frequency which is chosen depends on the characteristics of the coins or other objects expected to be input. In one embodiment, the low frequency is between about 50 KHz and about 500 KHz, preferably about 200 KHz and the high frequency is between about 0.5 MHz and about 10 MHz, preferably about 2 Mhz.

In some situations, it may be necessary to provide a first driving signal frequency component in order to achieve a second, different frequency sensor signal component. In particular, it is found that if the sensor 212 (FIG. 2) is first driven at the high frequency using high frequency coil 242 and then the low frequency signal 220 is added, adding the low frequency signal will affect the frequency of the high frequency signal 242. Thus, the high frequency driving signal may need to be adjusted to drive at a nominal frequency which is different from the desired high frequency of the sensor such that when the low frequency is added, the high frequency is perturbed into the desired value by the addition of the low frequency.

Figure 2C:
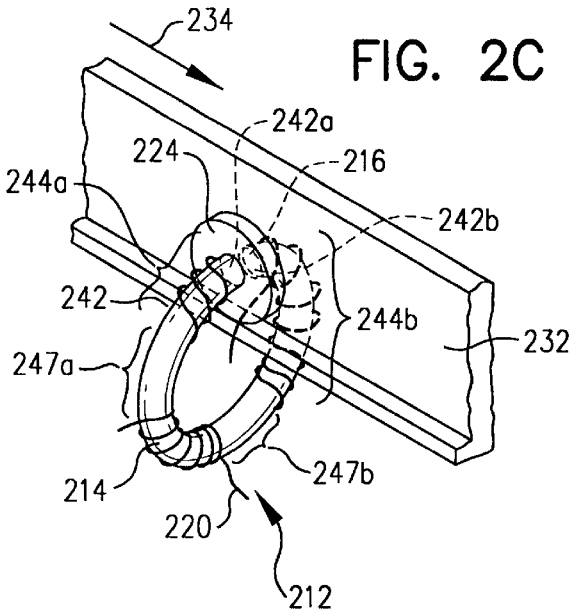
Figure 2D:
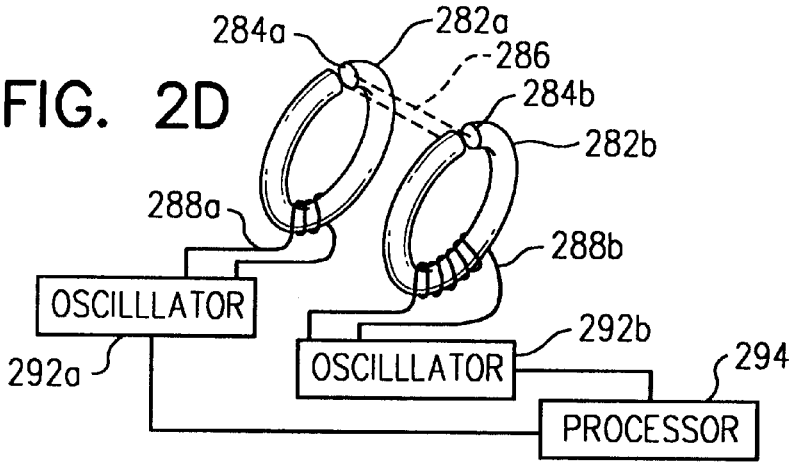
FIG. 2D depicts a two-core configuration according to an embodiment of the present invention.

Multiple frequencies can be provided in a number of ways. In one embodiment, a single continuous wave form 702 (FIG. 7), which is the sum of two (or more) sinusoidal or periodic waveforms having different frequencies 704, 706, is provided to the sensor. As depicted in FIG. 2C, a sensor 214 is preferably configured with two different coils to be driven at two different frequencies. It is believed that, generally, the presence of a second coil can undesirably affect the inductance of the first coil, at the frequency of operation of the first coil. Generally, the number of turns of the first coil may be correspondingly adjusted so that the first coil has the desired inductance. In the embodiment of FIG. 2C, the sensor core 214 is wound in a lower portion with a first coil 220 for driving with a low frequency signal 706 and is wound in a second region by a second coil 242 for driving at a higher frequency 704. In the depicted embodiment, the high frequency coil 742 has a smaller number of turns and uses a larger gauge wire than the first coil 220. In the depicted embodiment, the high frequency coil 242 is spaced 242*a*, 242*b* from the first coil 220 and is positioned closer to the gap 216. Providing some separation 242*a*, 242*b* is believed to help reduce the effect one coil has on the inductance of the other and may somewhat reduce direct coupling between the low frequency and high frequency signals.

Figure 7:
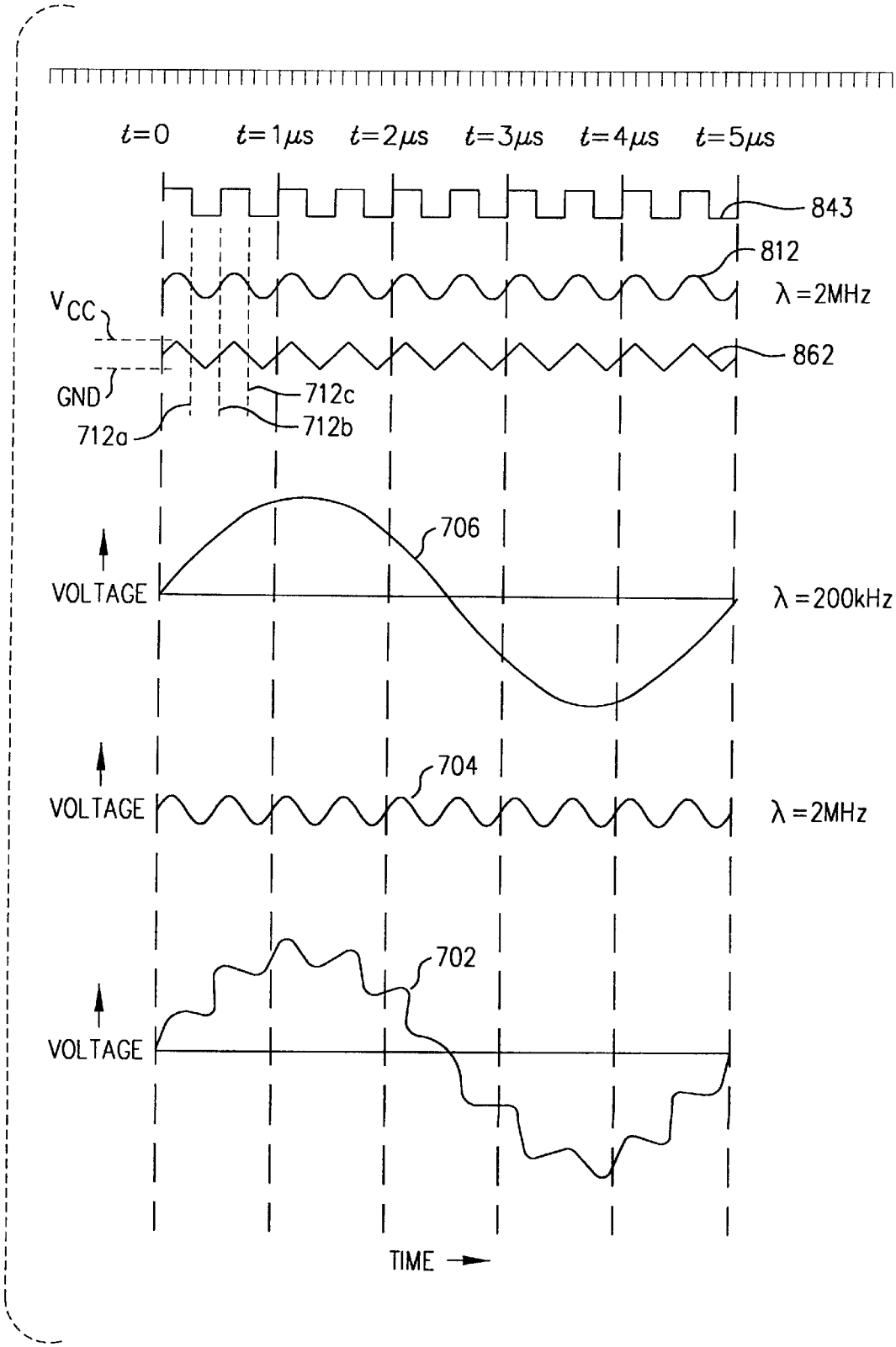
FIG. 7 depicts various signals that occur in the circuit of FIGS. 8A–C.

As can be seen from FIG. 7, the phase relationship of the high frequency signal 704 and low frequency signal 706 will affect the particular shape of the composite wave form 702. Signals 702 and 704 represent voltage at the terminals of the high and low frequency coils, 220, 242. If the phase relationship is not controlled, or at least known, output signals indicating, for example, amplitude and/or Q in the oscillator circuit as the coin passes the sensor may be such that it is difficult to determine how much of the change in amplitude or Q of the signal results from the passage of the coin and how much is attributable to the phase relationship of the two signals 704 and 706 in the particular cycle being analyzed. Accordingly, in one embodiment, the phases of the low and high signals 704, 706 are controlled such that sampling points along the composite signal 702 (described below) are taken at the same phase for both the low and high signals 704, 706. A number of ways of assuring the desired phase relationship can be used including generating both signals 704, 706 from a common reference source (such as a crystal oscillator) and/or using a phase locked loop (PLL) to control the phase relationship of the signals 704, 706. By using a phase locked loop, the wave shape of the composite signal 702 will be the same during any cycle (i.e., during any low frequency cycle), or at least will change only very slowly and thus it is possible to determine the sampling points (described below) based on, e.g., a pre-defined position or phase within the (low frequency) cycle rather than based on detecting characteristics of the wave form 702.

Figure 8A:
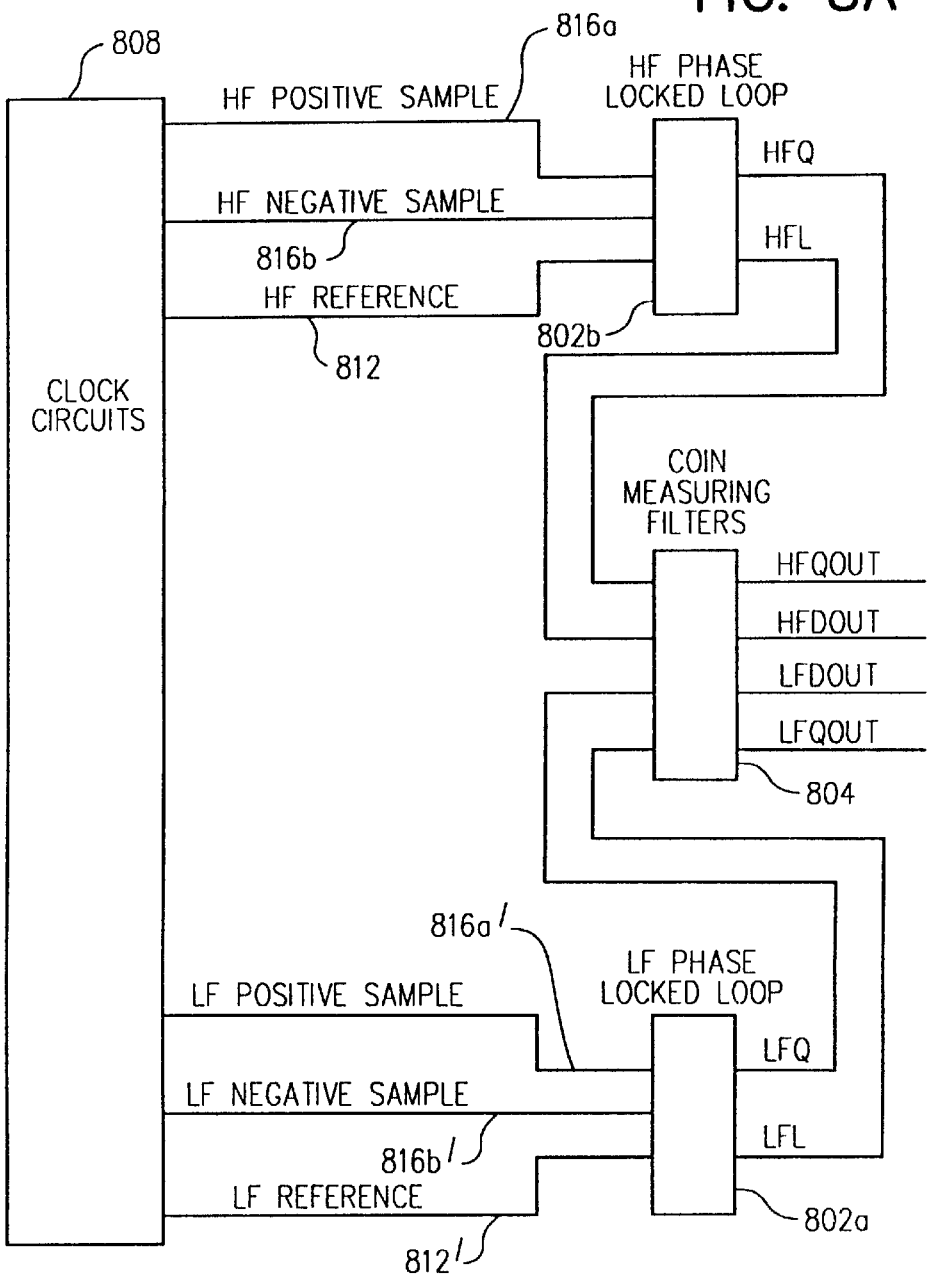
FIGS. 8A–8D are block and schematic diagrams of a circuit which may be used in connection with an embodiment of the present invention.
Figure 8B:
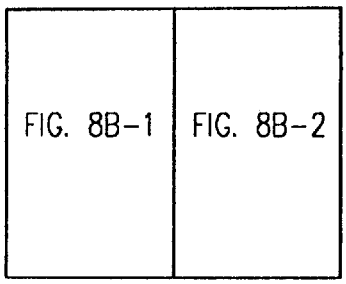
Figures 1, 8B:
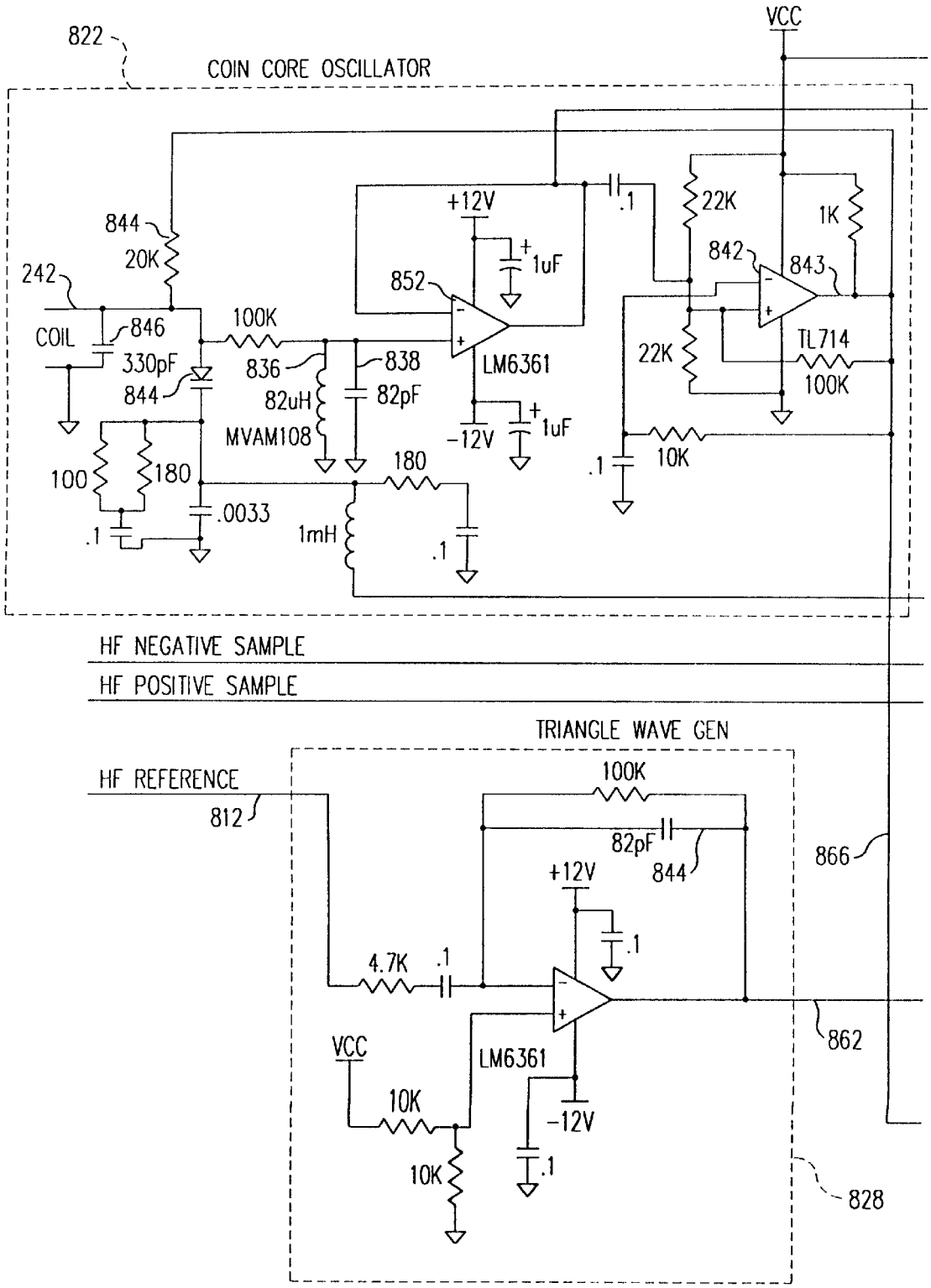
Figures 2, 8B:
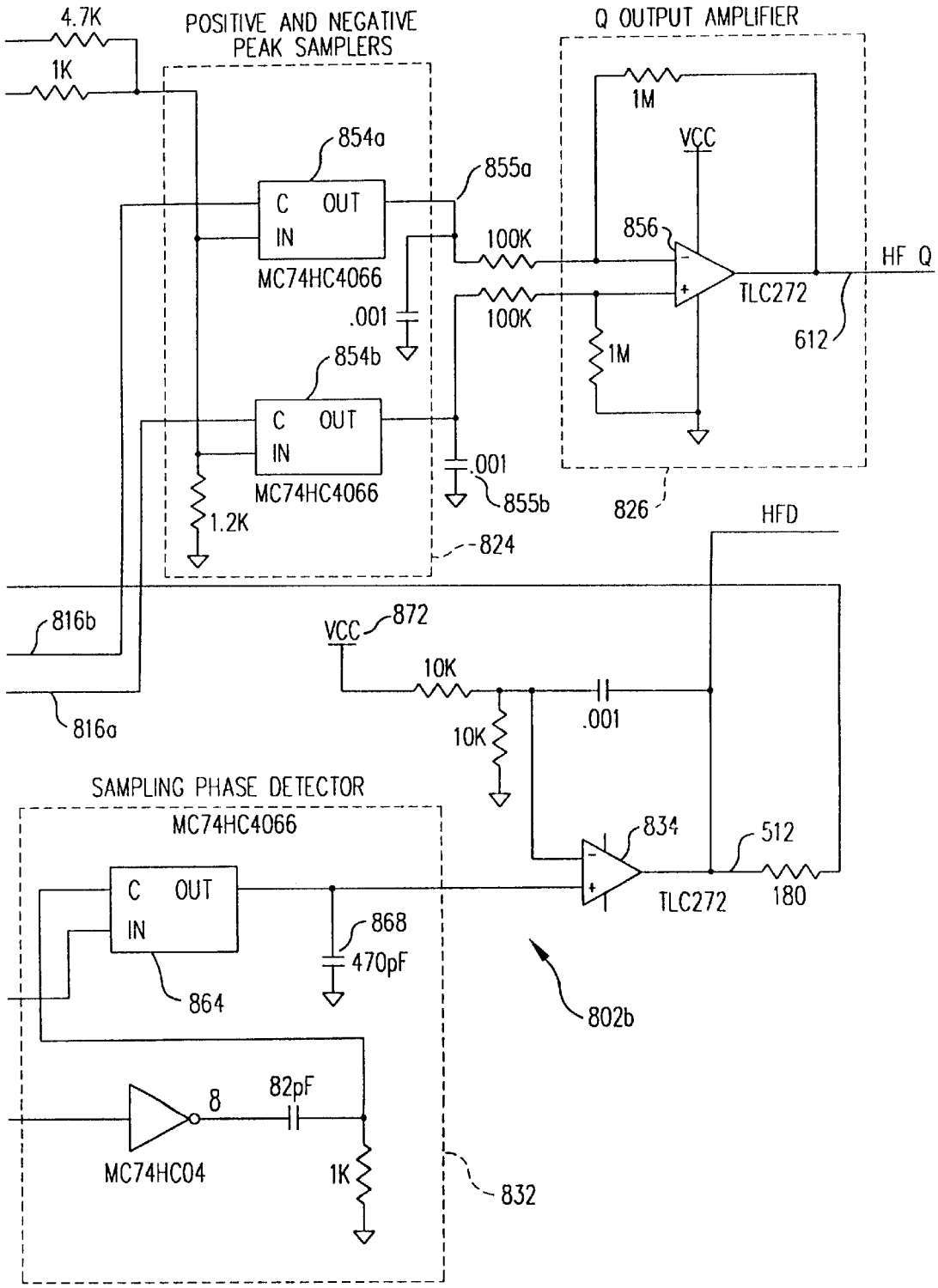
Figure 8C:
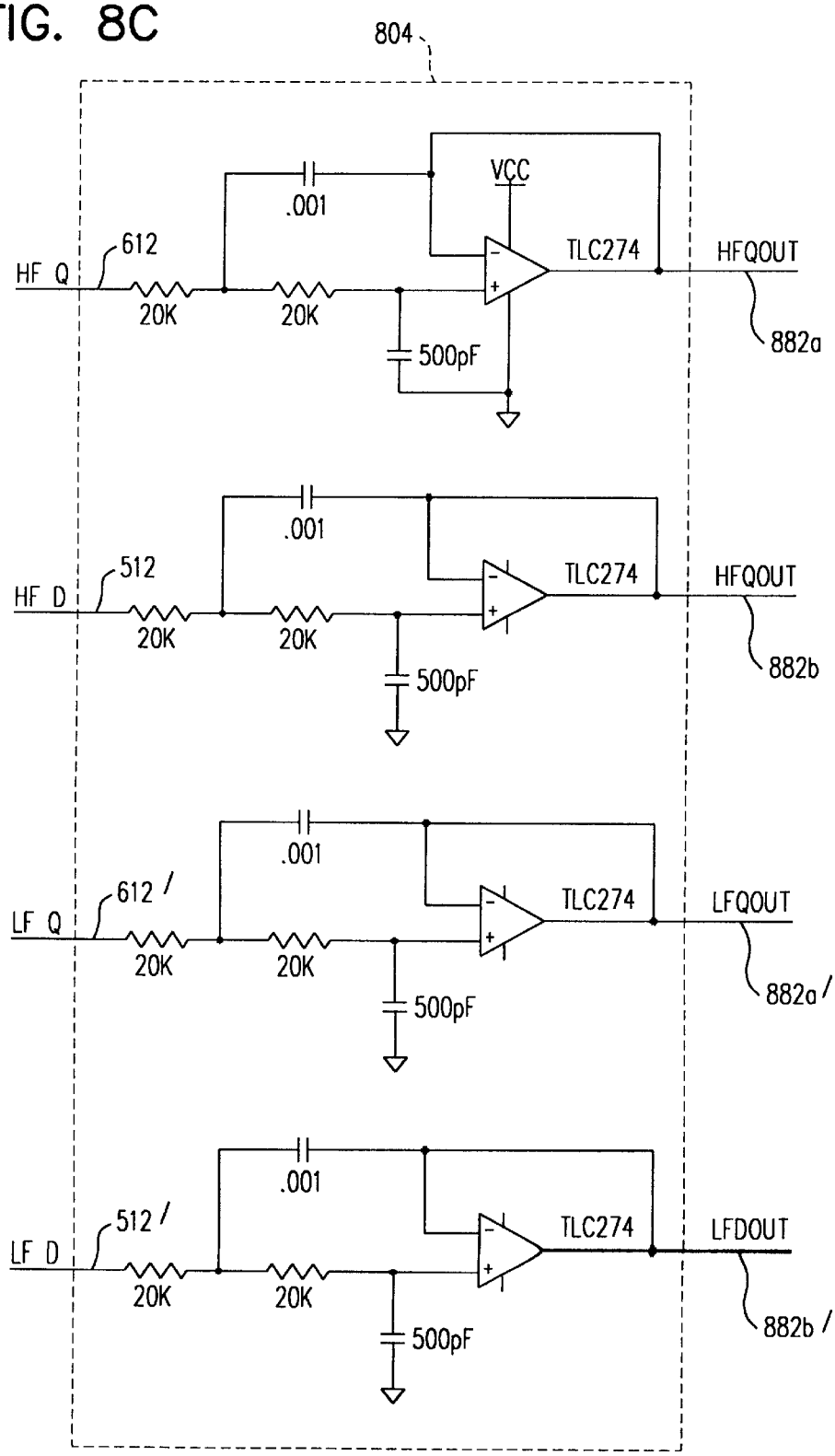
Figure 8D:
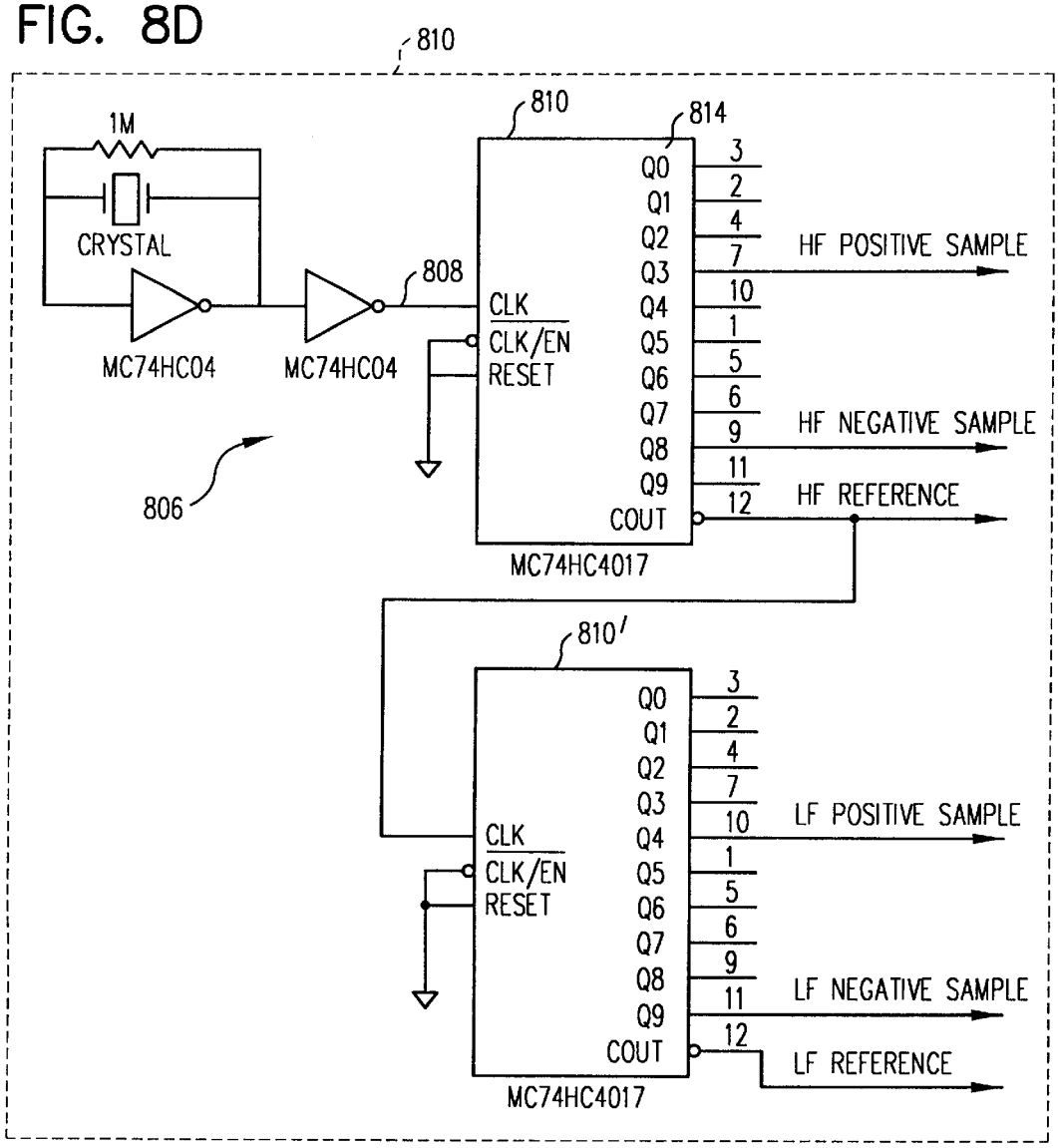

FIGS. 8A–8D depict circuitry which can be used for driving the sensor of FIG. 2C and obtaining signals useful in coin discrimination. The low frequency and high frequency coils 220, 242, form portions of a low frequency and high frequency phase locked loop, respectively 802*a*, 802*b*. Details of the clock circuits 808 are shown in FIG. 8D. The details of the high frequency phase locked loop are depicted in FIG. 8B and, the low frequency phase locked loop 802*a* may be identical to that shown in FIG. 8B except that some components may be provided with different values, e.g., as discussed below. The output from the phase locked loop is provided to filters, 804, shown in greater detail in FIG. 8C. The remainder of the components of FIG. 8A are generally directed to providing reference and/or sampling pulses or signals for purposes described more fully below.

The crystal oscillator circuit 806 (FIG. 8D) provides a reference frequency 808 input to the clock pin of a counter 810 such as a Johnson "divide by 10" counter. The counter outputs a high frequency reference signal 812 and various outputs Q0–Q9 define 10 different phase positions with respect to the reference signal 812. In the depicted embodiment, two of these phase position pulses 816*a*, 816*b* are provided to the high frequency phase locked loop 802*b* for purposes described below. A second counter 810' receives its clock input from the reference signal 812 and outputs a low frequency reference signal 812' and first and second low frequency sample pulses 816*a*' 816*b*' which are used in a fashion analogous to the use of the high frequency pulses 816*a* and 816*b* described below.

The high frequency phase locked loop circuit 802*b*, depicted in FIG. 8B, contains five main sections. The core oscillator 822 provides a driving signal for the high frequency coil 242. The positive and negative peak samplers 824 sample peak and trough voltages of the coil 242 which are provided to an output circuit 826 for outputting the high frequency Q output signal 612. The high frequency reference signal 812 is converted to a triangle wave by a triangle wave generator 828. The triangle wave is used, in a fashion discussed below, by a sampling phase detector 832 for providing an input to a difference amplifier 834 which outputs an error signal 512, which is provided to the oscillator 822 (to maintain the frequency and phase of the oscillator substantially constant) and provides the high frequency D output signal 512.

Low frequency phase locked loop circuit 802*a* is similar to that depicted in FIG. 8B except for the value of certain components which are different in order to provide appropriate low frequency response. In the high frequency circuit of FIG. 8B, an inductor 836 and capacitor 838 are provided to filter out low frequency, e.g. to avoid duty frequency cycling the comparator 842 (which has a low frequency component). This is useful to avoid driving low frequency and high frequency in the same oscillator 822. As seen in FIG. 8B, the inductor and capacitor have values, respectively, of 82 microhenrys and 82 picofarads. The corresponding components in the low frequency circuit 802A have values, respectively, of one microhenry and 0.1 microfarads, respectively (if such a filter is provided at all). In high frequency triangle wave generator, capacitor 844 is shown with a value of 82 picofarads while the corresponding component in the low frequency circuit 802*a* has a value of 0.001 microfarads.

Considering the circuit of FIG. 8B in somewhat greater detail, it is desired to provide the oscillator 822 in such a fashion that the frequency remains substantially constant, despite changes in inductance of the coil 242 (such as may arise from passage of a coin past the sensor). In order to achieve this goal, the oscillator 822 is provided with a voltage controllable capacitor (or varactor diode) 844 such that, as the inductance of the coil 242 changes, the capacitance of the varactor diode 844 is adjusted, using the error signal 512 to compensate, so as to maintain the LC resonant frequency substantially constant. In the configuration of FIG. 8B, the capacitance determining the resonant frequency is a function of both the varactor diode capacitance and the capacitance of fixed capacitor 846. Preferably, capacitor 846 and varactor diode 844 are selected so that the control voltage 512 can use the greater part of the dynamic range of the varactor diode and yet the control voltage 512 remains in a preferred range such as 0–5 volts (useful for outputting directly to a computer). Op amp 852 is a zero gain buffer amplifier (impedance isolator) whose output provides one input to comparator 842 which acts as a hard limiter and has relatively high gain. The hard-limited (square wave) output of comparator 842 is provided, across a high value resistor 844 to drive the coil 242. The high value of the resistance 844 is selected such that nearly all the voltage of the square wave is dropped across this resistor and thus the resulting voltage on the coil 242 is a function of its Q. In summary, a sine wave oscillation in the LC circuit is converted to a constant amplitude square wave signal driving the LC circuit so that the amplitude of the oscillations in the LC circuit are directly a measure of the Q of the circuit.

In order to obtain a measure of the amplitude of the voltage, it is necessary to sample the voltage at a peak and a trough of the signal. In the embodiment of FIG. 8B, first and second switches 854*a*, 854*b* provide samples of the voltage value at times determined by the high frequency pulses 816*a*, 816*b*. In one embodiment, the timing is determined empirically by selecting different outputs 814 from the counter 810. As seen in FIG. 8A, the (empirically selected) outputs used for the high frequency circuit may be different from those used for the low frequency circuit, e.g., because of differing delays in the two circuits and the like. Switches 854 and capacitors 855 form a sample and hold circuit for sampling peak and trough voltages and these voltages are provided to differential amplifier 856 whose output 612 is thus proportional to the amplitude of the signal in the LC circuit and, accordingly is inversely proportional to Q (and thus related to conductance of the coin). Because the phase locked loops for the low and high frequency signals are locked to a common reference, the phase relationship between the two frequency components is fixed, and any interference between the two frequencies will be common mode (or nearly so), since the wave form will stay nearly the same from cycle to cycle, and the common mode component will be subtracted out by the differential amplifier 856.

In addition to providing an output 612 which is related to coin conductance, the same circuit 802*b* also provides an output 512 related to coin diameter. In the embodiment of FIG. 8B, the high frequency diameter signal HFD 512 is a signal which indicates the magnitude of the correction that must be applied to varactor diode 844 to correct for changes in inductance of the coil 242 as the coin passes the sensor. FIG. 7 illustrates signals which play a role in determining whether correction to the varactor diode 844 is needed. If there has been no change in the coil inductance 242, the resonant frequency of the oscillator 822 will remain substantially constant and will have a substantially constant phase relationship with respect to the high frequency reference signal 812. Thus, in the absence of the passage of a coin past the sensor (or any other disturbance of the inductance of the coil 242) the square wave output signal 843 will have a phase which corresponds to the phase of the reference signal 812 such that at the time of each edge 712*a*, 712*b*, 712*c* of the oscillator square wave signal 843, the reference signal 812 will be in a phase midway between the wave peak and wave trough. Any departure from this condition indicates there has been a change in the resonant frequency of the oscillator 822 (and consequent phase shift) which needs to be corrected. In the embodiment of FIG. 8B, in order to detect and correct such departures, the reference signal 812 is converted, via triangle wave generator 828, to a triangle wave 862 having the same phase as the reference signal 812. This triangle wave 862 is provided to an analog switch 864 which samples the triangle wave 862 at times determined by pulses generated in response to edges of the oscillator square wave signal 843, output over line 866. The sampled signals are held by capacitor 868. As can be seen from FIG. 7, if there has been no change in the frequency or phase relationship of the oscillator signal 843, at the times of the square wave edges 712*a*, 712*b*, 712*c*, the value of the square wave signal 862 will be half way between the peak value and the trough value. In the depicted embodiment, the triangle wave 862 is configured to have an amplitude equal to the difference between VCC (typically 5 volts) and ground potential. Thus, difference amplifier 834 is configured to compare the sample values from the triangle wave 862 with one-half of VCC 872. If the sampled values from the triangle wave 862 are half way between ground potential and VCC, the output 512 from comparator 834 will be zero and thus there will be no error signal-induced change to the capacitance of varactor diode 844. However, if the sampled values from the triangle wave 862 are not halfway between ground potential and VCC, difference amplifier 834 will output a voltage on line 512 which is sufficient to adjust the capacitance of varactor diode 844 in an amount and direction needed to correct the resonant frequency of the oscillator 822 to maintain the frequency at the desired substantially constant value. Thus signal 512 is a measure of the magnitude of the changes in the effective inductance of the coil 242, e.g., arising from passage of a coin past the sensor. As shown in FIG. 8A, outputs 612, 512 from the high frequency PLL circuit as well as corresponding outputs 612' 512' from the low frequency PLL are provided to filters 804. The depicted filters 804 are low pass filters configured for noise rejection. The pass bands for the filters 804 are preferably selected to provide desirable signal to noise ratio characteristic for the output signals 882*a*, 882*b*, 882*a*', 882*b*'. For example, the bandwidth which is provided for the filters 804 may depend upon the speed at which coins pass the sensors, and similar factors.

In one embodiment, the output signals 88*a*, 882*b*, 882*a*', 882*b*' are provided to a computer for coin discrimination or other analysis. Before describing examples of such analysis, it is believed useful to describe the typical profiles of the output signals 882*a*, 882*b*, 882*a*', 882*b*'. FIG. 9 is a graph depicting the output signals, e.g., as they might appear if the output signals were displayed on a properly configured oscilloscope. In the illustration of FIG. 9, the values of the high and low frequency Q signals 882*a*, 882*a*' and the high and low frequency D signals 882*b*, 882*b*' have values (depicted on the left of the graph of FIG. 9) prior to passage of a coin past the sensor, which change as indicated in FIG. 9 as the coin moves toward the sensor, and is adjacent or centered within the gap of the sensor at time T1, returning to substantially the original values as the coin moves away from the sensor at time T2.

The signals 882*a*, 882*b*, 882*a*', 882*b*' can be used in a number of fashions to characterize coins or other objects as described below. The magnitude of changes 902*a*, 902*a*' of the low frequency and high frequency D values as the coin passes the sensor and the absolute values 904, 904' of the low and high frequency Q signals 882*a*', 882*a*, respectively, at the time T1 when the coin or other object is most nearly aligned with the sensor (as determined e.g., by the time of the local maximum in the D signals 882*b*, 882*b*') are useful in characterizing coins. Both the low and high frequency Q values are useful for discrimination. Laminated coins show significant differences in the Q reading for low vs. high frequency. The low and high frequency "D" values are also useful for discrimination. It has been found that some of all of these values are, at least for some coin populations, sufficiently characteristic of various coin denominations that coins can be discriminated with high accuracy.

Figure 10A:
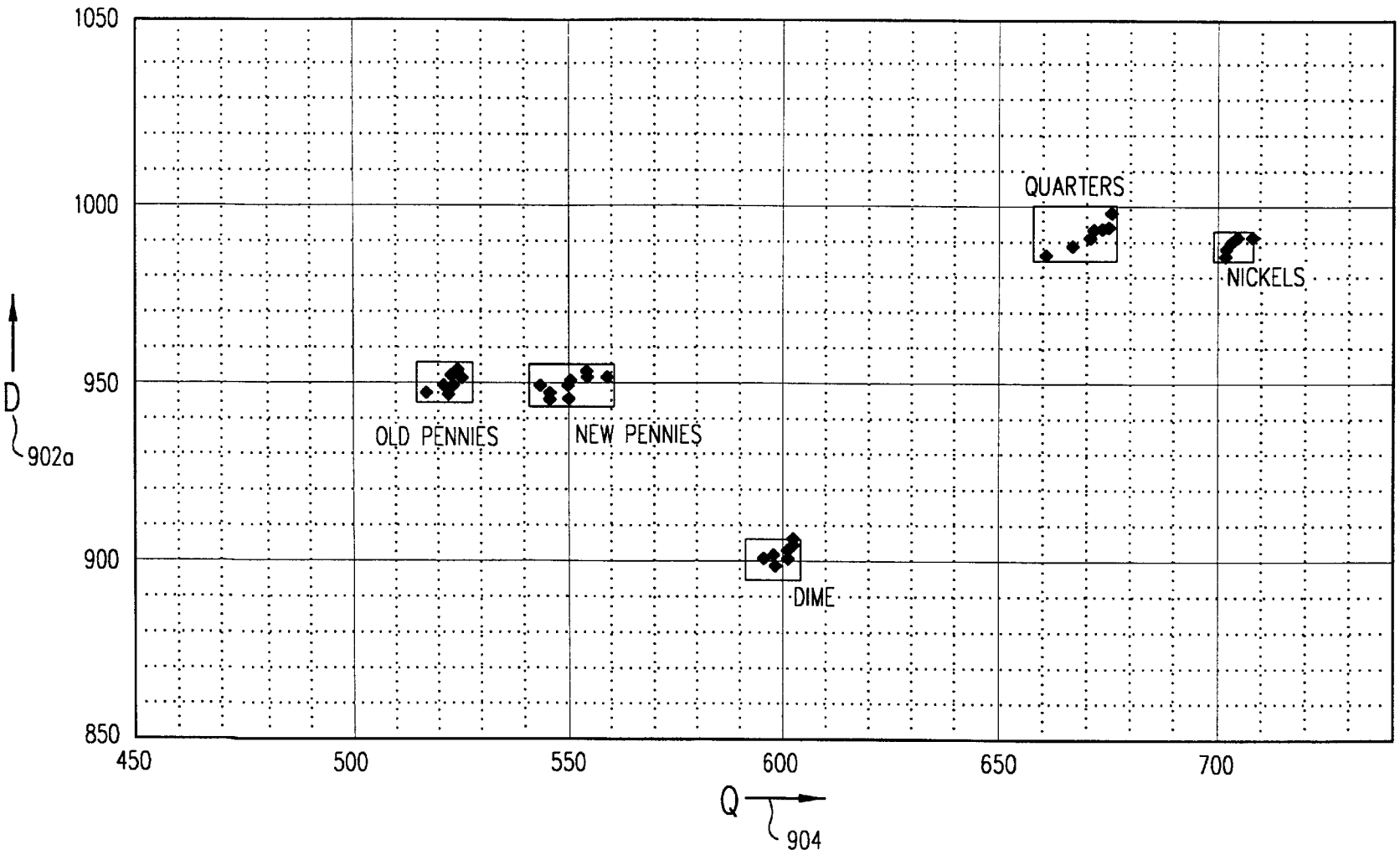
FIGS. 10A and 10B depict standard data and tolerance regions of a type that may be used for discriminating coins on the basis of data output by sensors of the present invention.
Figure 10B:
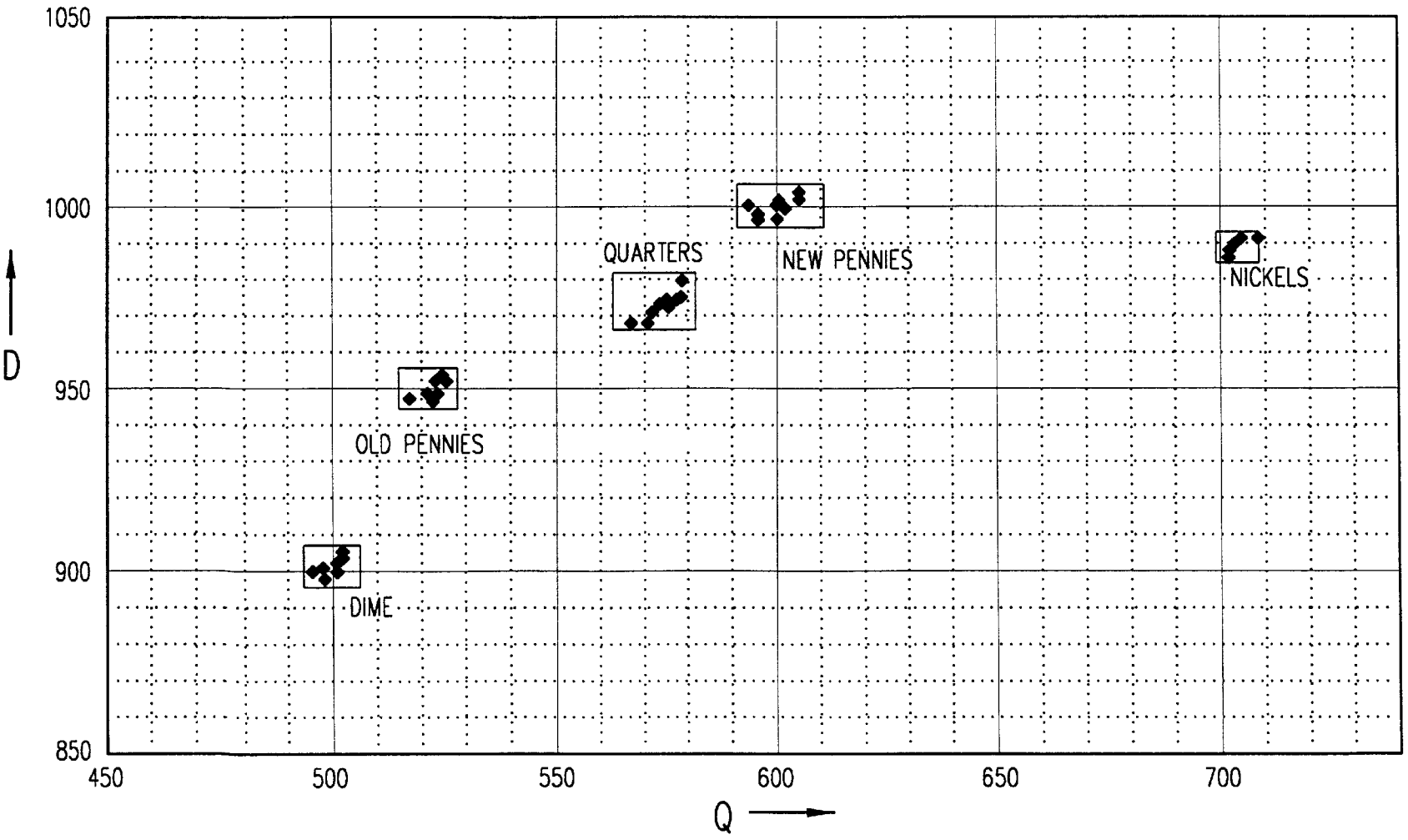

In one embodiment, values 902*a*, 902*a*', 904, 904' are obtained for a large number of coins so as to define standard values characteristic of each coin denomination. FIGS. 10A and 10B depict high and low frequency Q and D data for different U.S. coins. The values for the data points in FIGS. 10A and 10B are in arbitrary units. A number of features of the data are apparent from FIGS. 10A and 10B. First, it is noted that the Q, D data points for different denominations of coins are clustered in the sense that a given Q, D data point for a coin tends to be closer to data points for the same denomination coin than for a different denomination coin. Second, it is noted that the relative position of the denominations for the low frequency data (FIG. 10B) are different from the relative positions for corresponding denominations in the high frequency graph FIG. 10A.

One method of using standard reference data of the type depicted in FIGS. 10A and 10B to determine the denomination of an unknown coin is to define Q, D regions on each of the high frequency and low frequency graphs in the vicinity of the data points. For example, in FIGS. 10A and 10B, regions 1002*a*–1002*e*, 1002*a*'–1002*e*are depicted as rectangular areas encompassing the data points. According to one embodiment, when low frequency and high frequency Q and D data are input to the computer in response to the coin moving past the sensor, the high frequency Q, D values for the unknown coin are compared to each of the regions 1002*a*–1002*e* of the high frequency graph and the low frequency Q, D data is compared to each of the regions 1002*a*'–1002*e*' of the low frequency graph FIG. 10B. If the unknown coin lies within the predefined regions corresponding to the same denomination for each of the two graphs FIG. 10A FIG. 10B, the coin is indicated as having that denomination. If the Q, D data falls outside the regions 1002*a*–1002*e*, 1002*a*'–1002*e*' on the two graphs or if the data point of the unknown coin or object falls inside a region corresponding to a first denomination with a high frequency graph but a different denomination with low frequency graph, the coin or other object is indicated as not corresponding to any of the denominations defined in the graph of FIGS. 10A and 10B.

As will be apparent from the above discussion, the error rate that will occur in regard to such an analysis will partially depend on the size of the regions 1002*a*–1002*e*, 1002*a*'–1002*e*' which are defined. Regions which are too large will tend to result in an unacceptably large number of false positives (i.e., identifying the coin as being a particular denomination when it is not) while defining regions which are too small will result in an unacceptably large number of false negatives (i.e., failing to identify a legitimate coin denomination). Thus, the size and shape of the various regions may be defined or adjusted, e.g. empirically, to achieve error rates which are no greater than desired error rates. In one embodiment, the windows 2002*a*–2002*e*, 2002*a*'–2002*e*' have a size and shape determined on the basis of a statistical analysis of the Q, D values for a standard or sample coin population, such as being equal to 2 or 3 standard deviations from the mean Q, D values for known coins. The size and shape of the regions 1002*a*–1002*e*, 1002*a*'–1002*e*' may be different from one another, i.e., different for different denominations and/or different for the low frequency and high frequency graphs. Furthermore, the size and shape of the regions may be adjusted depending on the anticipated coin population (e.g., in regions near national borders, regions may need to be defined so as to discriminate foreign coins, even at the cost of raising the false negative error rate whereas such adjustment of the size or shape of the regions may not be necessary at locations in the interior of a country where foreign coins may be relatively rare).

If desired, the computer can be configured to obtain statistics regarding the Q, D values of the coins which are discriminated by the device in the field. This data can be useful to detect changes, e.g., changes in the coin population over time, or changes in the average Q, D values such as may result from aging or wear of the sensors or other components. Such information may be used to adjust the software or hardware, perform maintenance on the device and the like. In one embodiment, the apparatus in which the coin discrimination device is used may be provided with a communication device such as a modem and may be configured to permit the definition of the regions 1002*a*–1002*e*, 1002*a*'–1002*e*' or other data or software to be modified remotely (i.e., to be downloaded to a field site from a central site). In another embodiment, the device is configured to automatically adjust the definitions of the regions 1002*a*–1002*e*, 1002*a*'–1002*e*' in response to ongoing statistical analysis of the Q, D data for coins which are discriminated using the device, to provide a type of self calibration for the coin discriminator.

In light of the above description, a number advantages of the present invention can be seen. In one embodiment, the device provides for ease of application (e.g. multiple measurements done simultaneously and/or at one location), increased performance, such as improved throughput and more accurate discrimination, reduced cost and/or size. One or more torroidal cores can be used for sensing properties of coins or other objects passing through a magnetic field, created in or adjacent a gap in the torroid, thus allowing coins, disks, spherical, round or other objects, to be measured for their physical, dimensional, or metallic properties (preferably two or more properties, in a single pass over or through one sensor). The device facilitates rapid coin movement and high throughput. The device provides for better discrimination among coins and other objects than many previous devices, particularly with respect to U.S. dimes and pennies, while requiring fewer sensors and/or a smaller sensor region to achieve this result. Preferably, multiple parameters of a coin are measured substantially simultaneously and with the coin located in the same position, e.g., multiple sensors are co-located at a position on the coin path, such as on a rail. Coin handling apparatus having a lower cost of design, fabrication, shipping, maintenance or repair can be achieved. In one embodiment, a single sensor exposes a coin to two different electromagnetic frequencies substantially simultaneously, and substantially without the need to move the coin to achieve the desired two-frequency measurement. In this context, "substantially" means that, while there may be some minor departure from simultaneity or minor coin movement during the exposure to two different frequencies, the departure from simultaneity or movement is no so great as to interfere with certain purposes of the invention such as reducing space requirements, increasing coin throughput and the like, as compared to previous devices. For example, preferably, during detection of the results of exposure to the two frequencies, a coin will move less than a diameter of the largest-diameter coin to be detected, more preferably less than about ¾ a largest-coin diameter and even more preferably less than about ½ of a coin diameter.

The present invention makes possible improved discrimination, lower cost, simpler circuit implementation, smaller size, and ease of use in a practical system. Preferably, all parameters needed to identify a coin are obtained at the same time and with the coin in the same physical location, so software and other discrimination algorithms are simplified.

A number of variations and modifications of the invention can be used. It is possible to use some aspects of the invention without using others. For example, the described techniques and devices for providing multiple frequencies at a single sensor location can be advantageously employed without necessarily using the sensor geometry depicted in FIGS. 2–4. It is possible to use the described torroid-core sensors, while using analysis, devices or techniques different from those described herein and vice versa. Although the sensors have been described in connection with the coin counting or handling device, sensors can also be used in connection with coin activated devices, such as vending machines, telephones, gaming devices, and the like. In addition to discriminating among coins, devices can be used for discriminating and/or quality control on other devices such as for small, discrete metallic parts such as ball bearings, bolts and the like. Although the depicted embodiments show a single sensor, it is possible to provide adjacent or spaced multiple sensors (e.g., to detect one or more properties or parameters at different skin depths). The sensors of the present invention can be combined with other sensors, known in the art such as optical sensors, mass sensors, and the like. In the depicted embodiment, the coin 242 is positioned on both a first side 244*a* of the gap and a second side 244*b* of the gap. It is believed that as the coin 224 moves down the rail 232, it will be typically positioned very close to the second portion 244*b* of the coil 242. If it is found that this close positioning results in an undesirably high sensitivity of the sensor inductance to the coin position (e.g. an undesirably large variation in inductance when coins "fly" or are otherwise somewhat spaced from the back wall of the rail 232), it may be desirable to place the high frequency coil 242 only on the second portion 244*a* (FIG. 2C) which is believed to be normally somewhat farther spaced from the coin 242 and thus less sensitive to coin positional variations.

In the embodiment depicted in FIGS. 8A–8C, the apparatus can be constructed using parts which are all currently readily available and relatively low cost. As will be apparent to those of skill in the art, other circuits may be configured for performing functions useful in discriminating coins using the sensor of FIGS. 2–4. Some embodiments may be useful to select components to minimize the effects of temperature, drift, etc. In some situations, particularly high volume situations, some or all of the circuitry may be provided in an integrated fashion such as being provided on an application specific integrated circuit (ASIC). In some embodiments it may be desirable to switch the relative roles of the square wave 843 and triangle wave 862. For example, rather than obtaining a sample pulse based on a square wave signal 843, a circuit could be used which would provide a pulse reference that would go directly to the analog switch (without needing an edge detect). The square wave would be used to generate a triangular wave.

The phase locked loop circuits described above use very high (theoretically infinite) DC gain such as about 100 dB or more on the feedback path, so as to maintain a very small phase error. In some situations this may lead to difficulty in achieving phase lock up, upon initiating the circuits and thus it may be desirable to relax, somewhat, the small phase error requirements in order to achieve initial phase lock up more readily.

Although the embodiment of FIGS. 8A–8C provides for two frequencies, it is possible to design a detector using three or more frequencies, e.g. to provide for better coin discrimination.

Additionally, rather than providing two or more discrete frequencies, the apparatus could be configured to sweep or "chirp" through a frequency range. In one embodiment, in order to achieve swept-frequency data it would be useful to provide an extremely rapid frequency sweep (so that the coin does not move a large distance during the time required for the frequency to sweep) or to maintain the coin stationary during the frequency sweep.

In some embodiments in place of or in addition to analyzing values obtained at a single time (T1 FIG. 9) to characterize coins or other objects, it may be useful to use data from a variety of different times to develop a Q vs. t profile or D vs. t profile (where t represents time) for detected objects. For example, it is believed that larger coins such as quarters, tend to result in a Q vs. t profile which is flatter, compared to a D vs. t profile, than the profile for smaller coins. It is believed that some, mostly symmetric, waveforms have dips in the middle due to an "annular" type coin where the Q of the inner radius of the coin is different from the Q of the outer annulus. It is believed that, in some cases, bumps on the leading and trailing edges of the Q waveforms may be related to the rim of the coin or the thickness of plating or lamination near the rim of the coin.

In some embodiments the output data is influenced by relatively small-scale coin characteristics such as plating thickness or surface relief. In some circumstances it is believed that surface relief information can be used, e.g., to distinguish the face of the coin, (to distinguish "heads" from "tails") to distinguish old coins from new coins of the same denomination and the like. In order to prevent rotational orientation of the coin from interfering with proper surface relief analysis, it is preferable to construct sensors to provide data which is averaged over annular regions such as a radially symmetric sensor or array of sensors configured to provide data averaged in annular regions centered on the coin face center.

Although FIG. 5 depicts one fashion of obtaining a signal related to Q, other circuits can also be used. In the embodiment depicted in FIG. 5, a sinusoidal voltage is applied to the sensor coil 220, e.g., using an oscillator 1102. The waveform of the current in the coil 220, will be affected by the presence of a coin or other object adjacent the gap 216, 316, as described above. Different phase components of the resulting current wave form can be used to obtain data related to inductance and Q respectively. In the depicted embodiment, the current in the coil 220 is decomposed into at least two components, a first component which is in-phase with the output of the oscillator 1102, and a second component which is delayed by 90 degrees, with respect to the output of the oscillator 1102. These components can be obtained using phase-sensitive amplifiers 1104, 1106 such as a phase locked loop device and, as needed, a phase shift or delay device of a type well known in the art. The in-phase component is related to Q, and the 90 degree lagging component is related to inductance. In one embodiment, the output from the phase discriminators 1104, 1106, is digitized by an analog-to-digital converter 1108, and processed by a microprocessor 1110. In one implementation of this technique, measurements are taken at many frequencies. Each frequency drives a resistor connected to the coil. The other end of the coil is grounded. For each frequency, there is a dedicated "receiver" that detects the I and Q signals. Alternatively, it is possible to analyze all frequencies simultaneously by employing, e.g., a fast Fourier transform (FFT) in the microprocessor. In another embodiment, it is possible to use an impedance analyzer to read the Q (or "loss tangent") and inductance of a coil.

Figure 12:
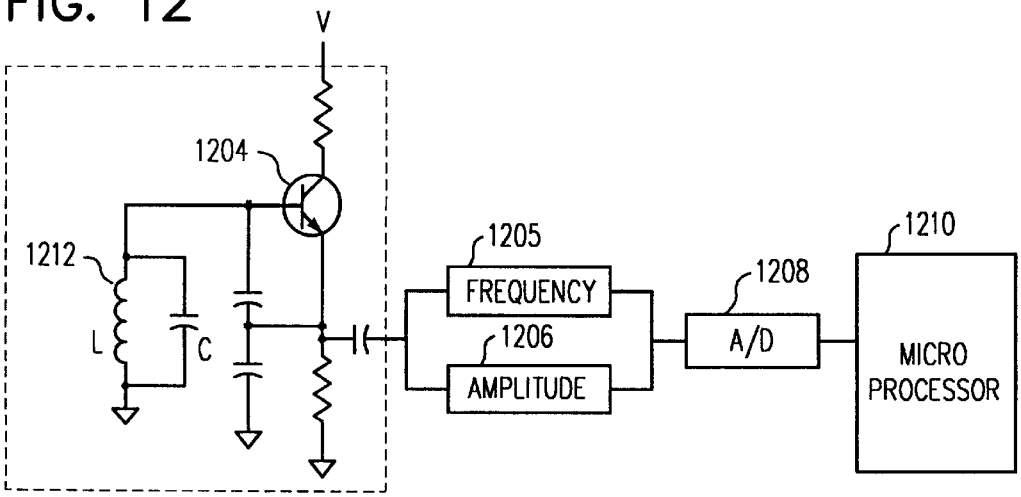
FIG. 12 is a schematic and block diagram of a discrimination advice according to an embodiment of the present invention.

In another embodiment, depicted in FIG. 12, information regarding the coin parameters is obtained by using the sensor 1212 as an inductor in an LC oscillator 1202. A number of types of LC oscillators can be used as will be apparent to those of skill in the art, after understanding the present disclosure. Although a transistor 1204 has been depicted, other amplifiers such as op amps, can be used in different configurations. In the depicted embodiment, the sensor 1212 has been depicted as an inductor, since presence of a coin in the vicinity of the sensor gap will affect the inductance. Since the resonant frequency of the oscillator 1202 is related to the effective inductance (frequency varies as $(1/LC)^{-1/2}$): as the diameter of the coin increases, the frequency of the oscillator increases. The amplitude of the AC in the resonant LC circuit, is affected by the conductivity of objects in the vicinity of the sensor gap. The frequency is detected by frequency detector 1205, and by amplitude detector 1206, using well known electronics techniques with the results preferably being digitized 1208, and processed by microprocessor 1210. In one embodiment the oscillation loop is completed by amplifying the voltage, using a hard-limiting amplifier (square wave output), which drives a resistor. Changes in the magnitude of the inductance caused the oscillator's frequency to change. As the diameter of the test coin increases, the frequency of the oscillator increases. As the conductivity of the test coin decreases, the amplitude of the AC voltage and the tuned circuit goes down. By having a hard-limiter, and having a current-limiting resister that is much larger than the resonant impedance of the tuned circuit, the amplitude of the signal at the resonant circuit substantially accurately indicates, in inverse relationship, the Q of the conductor.

Although one manner of analyzing D and Q signals using a microprocessor is described above, a microprocessor can use the data in a number of other ways. Although it would be possible to use formulas or statistical regressions to calculate or obtain the numerical values for diameter (e.g., in inches) and/or conductivity (e.g., in mhos), it is contemplated that a frequent use of the present invention will be in connection with a coin counter or handler, which is intended to 1) discriminate coins from non-coin objects, 2) discriminate domestic from foreign coins and/or 3) discriminate one coin denomination from another. Accordingly, in one embodiment, the microprocessor compares the diameter-indicating data, and conductivity-indicating data, with standard data indicative of conductivity and diameter for various known coins. Although it would be possible to use the microprocessor to convert detected data to standard diameter and conductivity values or units (such as inches or mhos), and compare with data which is stored in memory in standard values or units, the conversion step can be avoided by storing in memory, data characteristic of various coins in the same values or units as the data received by the microprocessor. For example, when the detector of FIG. 5 and/or 6 outputs values in the range of e.g., 0 to +5 volts, the standard data characteristic of various known coins can be converted, prior to storage, to a scale of 0 to 5, and stored in that form so that the comparison can be made directly, without an additional step of conversion.

Although in one embodiment it is possible to use data from a single point in time, such as when the coin is centered on the gap 216, (as indicated, e.g., by a relative maximum, or minimum, in a signal), in another embodiment a plurality of values or a continuous signal of the values obtained as the coin moves past or through the gap 216 is preferably used.

Figure 13:
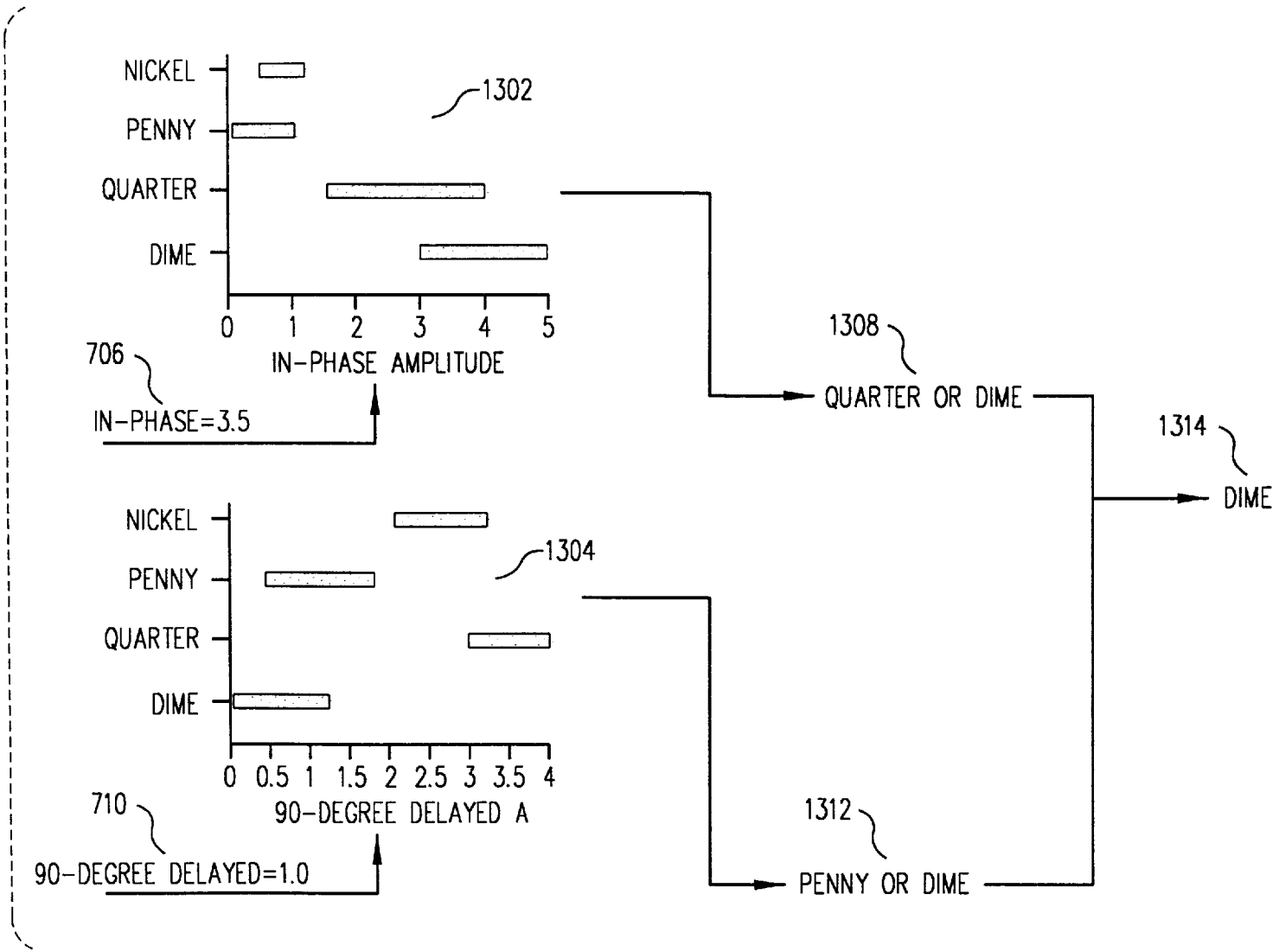
FIG. 13 depicts use of in-phase and delayed amplitude data for coin discriminating according to one embodiment.

An example of a single point of comparison for each of the in-phase and delayed detector, is depicted in FIG. 13. In this figure, standard data (stored in the computer), indicates the average and/or acceptance or tolerance range of in-phase amplitudes (indicative of conductivity), which has been found to be associated with U.S. pennies, nickels, dimes and quarters, respectively 1302. Data is also stored, indicating the average and/or acceptance or tolerance range of values output by the 90 degree delayed amplitude detector 406 (indicative of diameter) associated with the same coins 1304. Preferably, the envelope or tolerance is sufficiently broad to lessen the occurrence of false negative results, (which can arise, e.g., from worn, misshapen, or dirty coins, electronic noise, and the like), but sufficiently narrow to avoid false positive results, and to avoid or reduce substantial overlap of the envelopes of two or more curves (in order to provide for discrimination between denominations). Although, in the figures, the data stored in the computer is shown in graphical form, for the sake of clarity of disclosure, typically the data will be stored in digital form in a memory, in a manner well known in the computer art. In the embodiment in which only a single value is used for discrimination, the digitized single in-phase amplitude value, which is detected for a particular coin (in this example, a value of 3.5) (scaled to a range of 0 to 5 and digitized), is compared to the standard in-phase data, and the value of 3.5 is found (using programming techniques known in the art) to be consistent with either a quarter or a dime 1308. Similarly, the 90-degree delayed amplitude value which is detected for this same coin 1310 (in this example, a value of 1.0), is compared to the standard in-phase data, and the value of 1.0 is found to be consistent with either a penny or a dime 1312. Thus, although each test by itself would yield ambiguous results, since the single detector provides information on two parameters (one related to conductivity and one related to diameter), the discrimination can be made unambiguously since there is only one denomination (dime) 1314 which is consistent with both the conductivity data and the diameter data.

Figure 14:
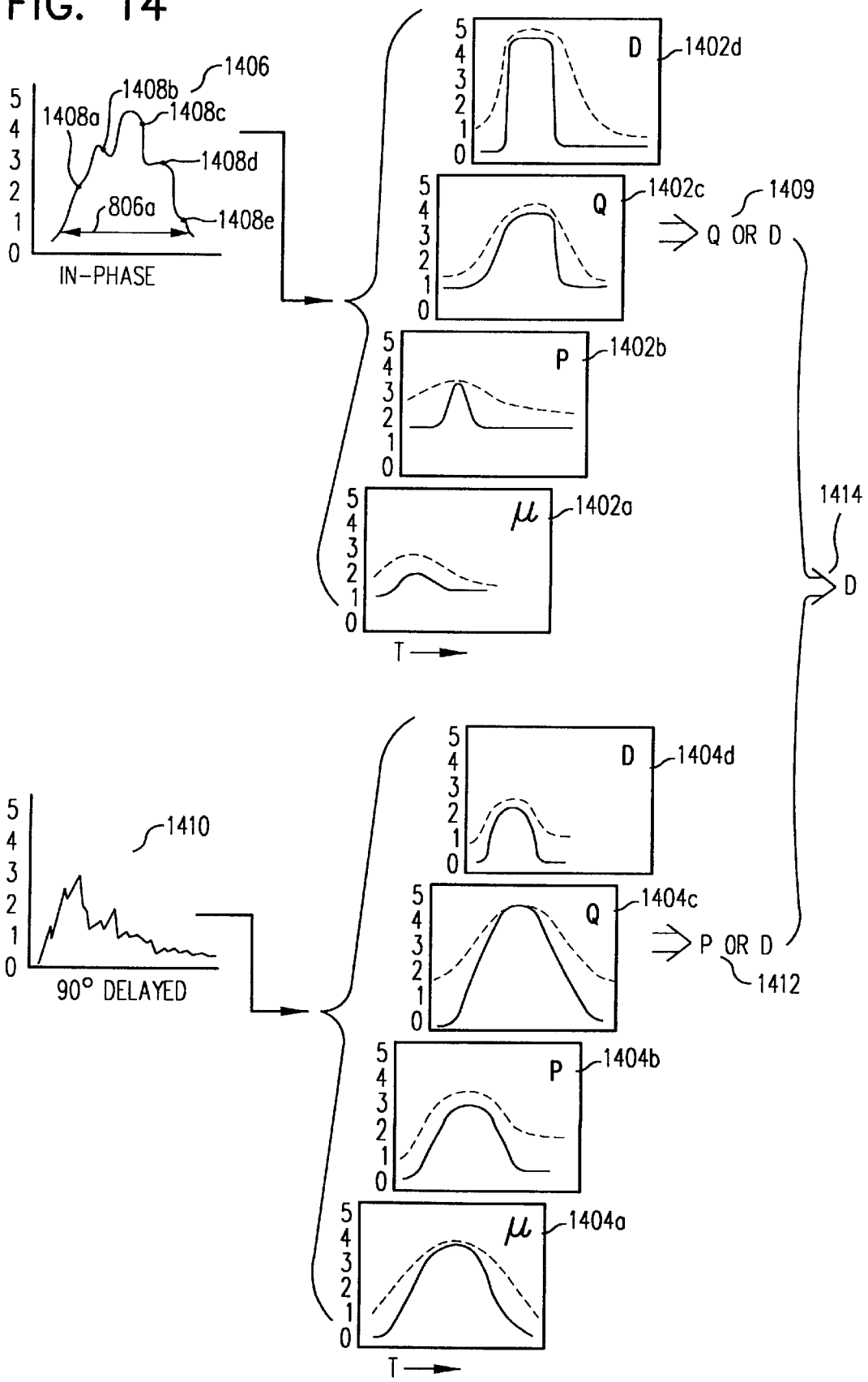
FIG. 14 depicts use of in-phase and delayed amplitude data for coin discriminating according to another embodiment.

As noted, rather than using single-point comparisons, it is possible to use multiple data points (or a continuous curve) generated as the coin moves past or through the gap 216, 316. Profiles of data of this type can be used in several different ways. In the example of FIG. 14, a plurality of known denominations of coins are sent through the discriminating device in order to accumulate standard data profiles for each of the denominations 1402*a, b, c, d*, 1404*a, b, c, d*. These represent the average change in output from the in-phase amplitude detector 1104 and a 90-degree delay detector for (shown on the vertical axes) 1403 and acceptance ranges or tolerances 1405 as the coins move past the detector over a period of time, (shown on the horizontal axis). In order to discriminate an unknown coin or other object, the object is passed through or across the detector, and each of the in-phase amplitude detector 1104 and 90-degree delayed amplitude detector 1106, respectively, produce a curve or profile 1406, 1410, respectively. In the embodiment depicted in FIG. 8, the in-phase profile 1406 generated as a coin passes the detector 212, is compared to the various standard profiles for different coins 1402*a*, 1402*b*, 1402*c*, 1402*d*. Comparison can be made in a number of ways. In one embodiment, the data is scaled so that a horizontal axis between initial and final threshold values 1406*a* equals a standard time, for better matching with the standard values 1402*a* through 1402*d*. The profile shown in 1406 is then compared with standard profiles stored in memory 1402*a* through 1402*d*, to determine whether the detected profile is within the acceptable envelopes defined in any of the curves 1402*a* through 1402*d*. Another method is to calculate a closeness of fit parameter using well known curve-fitting techniques, and select a denomination or several denominations, which most closely fit the sensed profile 1406. Still another method is to select a plurality of points at predetermined (sealed) intervals along the time axis 1406*a* (1408*a, b, c, d*) and compare these values with corresponding time points for each of the denominations. In this case, only the standard values and tolerances or envelopes at such predetermined times needs to be stored in the computer memory. Using any or all these methods, the comparison of the sensed data 1406, with the stored standard data 1402*a* through 1402*d* indicates, in this example, that the in-phase sensed data is most in accord with standard data for quarters or dimes 1409. A similar comparison of the 90-degree delayed data 1410 to stored standard 90-degree delayed data (1404*a* through 1404*d*), indicates that the sensed coin was either a penny or a dime. As before, using both these results, it is possible to determine that the coin was a dime 1404.

In one embodiment, the in-phase and out-of-phase data are correlated to provide a table or graph of in-phase amplitude versus 90-degree delayed amplitude for the sensed coin (similar to the Q versus D data depicted in FIGS. 10A and 10B), which can then be compared with standard in-phase versus delayed profiles obtained for various coin denominations in a manner similar to that discussed above in connection with FIGS. 10A and 10B.

Although coin acceptance regions are depicted (FIGS. 10A, 10B) as rectangular, they may have any shape.

In both the configuration of FIG. 2 and the configuration of FIGS. 3 and 4, the presence of the coin affects the magnetic field. It is believed that in some cases, eddy currents flowing in the coin, result in a smaller inductance as the coin diameter is larger, and also result in a lower Q of the inductor, as the conductivity of the coin is lower. As a result, data obtained from either the sensor of FIGS. 2A and 2B, or the sensor of FIGS. 3 and 4, can be gathered and analyzed by the apparatus depicted in FIGS. 5 and 6, even though the detected changes in the configuration of FIGS. 3 and 4 will typically be smaller than the changes detected in the configuration of FIGS. 2A and 2B.

Although certain sensor shapes have been described herein, the techniques disclosed for applying multiple frequencies on a single core could be applied to and of a number of sensor shapes, or other means of forming an inductor to subject a coin to an alternating magnetic field.

Although an embodiment described above provides two AC frequencies to a single sensor core at the same time, other approaches are possible, One approach is a time division approach, in which different frequencies are generated during different, small time periods, as the coin moves past the sensor. This approach presents the difficulty of controlling the oscillator in a "time-slice" fashion, and correlating time periods with frequencies for achieving the desired analysis. Another potential problem with time-multiplexing is the inherent time it takes to accurately measure Q in a resonant circuit. The higher the Q, the longer it takes for the oscillator's amplitude to settle to a stable value. This will limit the rate of switching and ultimately the coin throughput. In another embodiment, two separate sensor cores can be provided, each with its own winding and each driven at a different frequency. This approach has not only the advantage of reducing or avoiding harmonic interference, but provides the opportunity of optimizing the core materials or shape to provide the best results at the frequency for which that core is designed. When two or more frequencies are used, analysis of the data can be similar to that described above, with different sets of standard or reference data being provided for each frequency.

In another embodiment, current provided to the coil is a substantially constant or DC current. This configuration is useful for detecting magnetic (ferromagnetic) v. non-magnetic coins. As the coin moves through or past the gap, there will be eddy current effects, as well as permeability effects. As discussed above, these effects can be used to obtain, e.g., information regarding conductivity, such as core conductivity. Thus, in this configuration such a sensor can provide not only information about the ferromagnetic or non-magnetic nature of the coin, but also regarding the conductivity. Such a configuration can be combined with a high-frequency (skin effect) excitation of the core and, since there would be no low-frequency (and thus no low-frequency harmonics) interference problems would be avoided. It is also possible to use two (or more) cores, one driven with DC, and another with AC. The DC-driven sensor provides another parameter for discrimination (permeability). Permeability measurement can be useful in, for example, discriminating between U.S. coins and certain foreign coins or slugs. Preferably, computer processing is performed in order to remove "speed effects."

Although the invention has been described by way of a preferred embodiment and certain variations and modifications, other variations and modifications can also be used, the invention being defined by the following claims.

What is claimed is:

1. Apparatus usable for discriminating among coins and other discrete objects, comprising a sensor having a first integral magnetic core, said first core having first and second substantially opposed end faces defining a first gap, to define magnetic flux lines in the vicinity of said first gap;

first circuitry which initiates at least a first action in response to discrimination of an object using said sensor;

at least a first communications link coupling said sensor to said first circuitry to provide an output signal from said sensor to said first circuitry;

at least a first conductive coil coupled to said first core;

second circuitry which provides current defining at least a first frequency to said first coil;

a second magnetic core which is non-linear over at least a portion thereof, said second core defining a second gap to define magnetic flux lines in the vicinity of said second gap; and a second conductive coil coupled to said first core and third circuitry which provides current defining a second frequency to said second coil, said second frequency being different from said first frequency.

2. Apparatus, usable for discriminating among coins and other discrete objects, comprising:

a sensor having a first integral magnetic core, said first core having first and second substantially opposed end faces defining a first gap, to define magnetic flux lines in the vicinity of said first gap;

first circuitry which initiates at least a first action in response to discrimination of an object using said sensor; and at least a first communications link coupling said sensor to said first circuitry to provide an output signal from said sensor to said first circuitry at least a first conductive coil coupled to said first core;

second circuitry which provides, to said first coil, current which simultaneously defines at least first and second different frequencies.

3. Apparatus, as claimed in claim 2, wherein said first magnetic core is non-linear over at least a portion thereof.

4. Apparatus, as claimed in claim 2, wherein said first magnetic core is generally in the shape of a torus.

5. Apparatus as claimed in claim 2, further comprising a conveyance mechanism which conveys objects to said magnetic flux lines in the vicinity of said gap.

6. Apparatus, as claimed in claim 2, further comprising:

end plates coupled to said first and second substantially opposed end faces, respectively;

a conveyance mechanism which conveys coins past said sensor such that face planes defined by said coins are substantially parallel to said end plates and said coins are substantially adjacent said end plates.

7. Apparatus, as claimed in claim 2, wherein a DC current is applied to said first coil.

8. Apparatus, usable for discriminating among coins and other discrete objects, comprising:

a sensor having a first integral magnetic core, said first core having first and second substantially opposed end faces defining a first gap, to define magnetic flux lines in the vicinity of said first gap;

first circuitry which initiates at least a first action in response to discrimination of an object using said sensor;

at least a first communications link coupling said sensor to said first circuitry to provide an output signal from said sensor to said first circuitry;

at least a first conductive coil coupled to said first core;

a second magnetic core which is non-linear over at least a portion thereof, said second core defining a second gap to define magnetic flux lines in the vicinity of said second gap and;

second circuitry which provides current defining at least first and second different frequencies to said first coil.

9. Apparatus, as claimed in claim 8, further comprising second circuitry which provides current defining at least a first frequency to said first coil.

10. Apparatus, as claimed in claim 8, wherein the materials for said first core is different from the materials for said second core.

11. Apparatus usable for discriminating among coins and other discrete objects, comprising:

a sensor having a first integral magnetic core, said first core having first and second substantially opposed end faces defining a first gap to define magnetic flux lines in the vicinity of said first gap;

first circuitry which initiates at least a first action in response to discrimination of an object using said sensor;

at least a first communications link coupling said sensor to said first circuitry to provide an output signal from said sensor to said first circuitry;

at least a first conductive coil coupled to said first core;

second circuitry which provides current defining at least a first frequency to said first coil;

a second magnetic core which is non-linear over at least a portion thereof, said second core defining a second gap to define magnetic flux lines in the vicinity of said second gap; and at least a second conductive coil coupled to said second core and third circuitry which provides current defining at least a second frequency, different from said first frequency, to said second coil.

12. A method, usable for discriminating among coins and other discrete objects, comprising the steps of:

providing at least a first sensor having a first magnetic core which is non-linear over at least a portion thereof, said first core defining a first gap to define magnetic flux lines in the vicinity of said first gap;

providing a first periodic reference signal;

providing a first periodic waveform to induce a magnetic flux on said first magnetic core wherein said first periodic waveform is phase-locked to said reference signal measuring the amplitude and a phase locked loop error signal of the voltage induced in said first magnetic core as said object moves past said first gap.

13. A method, as claimed in claim 12, further comprising providing at least a first coil coupled to said first magnetic core and wherein said step of providing a first periodic waveform comprises applying a first periodic waveform to said coil.

14. A method, as claimed in claim 12, further comprising:

using said amplitude to calculate Q for deriving conductivity, and using said error signal to derive size.

15. A method, usable for discriminating among coins and other discrete objects, comprising the steps of:

providing at least a first sensor having a first magnetic core which is non-linear over at least a portion thereof, said first core defining a first gap to define magnetic flux lines in the vicinity of said first gap;

providing a first periodic reference signal;

providing a first periodic waveform to induce a magnetic flux on said first magnetic core wherein said first periodic waveform is phase-locked to said reference signal;

applying a second periodic waveform, having a frequency different from said first periodic waveform, to said magnetic core.

16. A method, as claimed in claim 15, further comprising providing a second coil coupled to said first magnetic core and applying a second periodic waveform to said second coil, said second periodic waveform having a frequency different from said first periodic waveform.

17. A method, usable for discriminating among coins and other discrete objects, comprising the steps of:

providing at least a first sensor having a first magnetic core which is non-linear over at least a portion thereof, said first core defining a first gap to define magnetic flux lines in the vicinity of said first gap;

providing a first periodic reference signal;

providing a first periodic waveform to induce a magnetic flux on said first magnetic core wherein said first periodic waveform is phase-locked to said reference signal providing a second coil coupled to said first magnetic core and applying a second periodic waveform to said second coil, said second periodic waveform having a frequency different from said first periodic waveform;

wherein said first and second periodic waveforms are both phase locked to a common reference to maintain a fixed phase relationship between the first and second periodic waveforms.

18. In a coin counting device that receives a plurality of coins in a first location and moves coins past a discriminator region for determining the denomination of the coins, calculating the total value of said plurality of coins and outputting an indication of said value, a sensor for measuring coin parameters in said discriminator region, the sensor comprising:

a ferrite core substantially in the shape of a section of a torroid and defining a gap, positioned so that a coin conveyed by said counting device will move through the vicinity of said gap;

at least a first coil of conductive material wound about a first portion of said core, defining an inductor;

an oscillator coupled to said inductor configured to provide current defining at least first and second different frequencies simultaneously on said first coil wherein, when a coin is conveyed past said gap, the signal in said inductor undergoes at least a first frequency shift and a first change in the quality factor of said inductor at said first frequency and a second frequency shift and a second change in quality factor of said inductor at said second frequency;

a processor configured to identify the denomination of said coin by comparing at least some of said frequency shifts and changes in quality factor to stored data indicative of frequency shift and quality factor values for a plurality of coins of different denomination.

19. The sensor of claim 18, wherein at least some of said coins comprise a core covered with a cladding having a cladding thickness wherein said first and second different frequencies are selected to define first and second skin depths, said first skin depth being less than said cladding thickness and said second skin depth being greater than said first skin depth, to permit separate characterization of said cladding and said core.

* * * * *